US010103455B2

(12) United States Patent
Takahashi et al.

(10) Patent No.: US 10,103,455 B2
(45) Date of Patent: Oct. 16, 2018

(54) CRIMP TERMINAL AND TERMINAL CRIMPING METHOD

(71) Applicant: Yazaki Corporation, Tokyo (JP)

(72) Inventors: Kazuhide Takahashi, Shizuoka (JP); Hidehiko Iwasawa, Shizuoka (JP); Keiichiroh Kurashige, Shizuoka (JP); Koichi Ikebe, Shizuoka (JP); Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/726,003

(22) Filed: Oct. 5, 2017

(65) Prior Publication Data

US 2018/0109010 A1 Apr. 19, 2018

(30) Foreign Application Priority Data

Oct. 13, 2016 (JP) ..... 2016-201869

(51) Int. Cl.
*H01R 4/18* (2006.01)
*H01R 13/04* (2006.01)
(Continued)

(52) U.S. Cl.
CPC ..... *H01R 4/183* (2013.01); *H01R 4/185* (2013.01); *H01R 13/04* (2013.01); *H01R 43/048* (2013.01); *H01R 4/62* (2013.01); *H01R 13/11* (2013.01)

(58) Field of Classification Search
CPC ..... H01R 4/183
(Continued)

(56) References Cited

U.S. PATENT DOCUMENTS 5,561,267 A * 10/1996 Fudoo ..... H01R 4/185 174/84 C
8,607,449 B2 * 12/2013 Kitagawa ..... H01R 4/185 174/110 R
8,870,611 B2 * 10/2014 Sato ..... H01R 4/188 439/442
8,974,258 B2 * 3/2015 Mitose ..... H01R 4/184 439/877
(Continued)

FOREIGN PATENT DOCUMENTS

JP 48-31825 U 4/1973
JP 2970362 B2 11/1999
(Continued)

OTHER PUBLICATIONS

Japanese Office Action for the related Japanese Patent Application No. 2016-201869 dated Aug. 28, 2018.

*Primary Examiner* — Tulsidas C Patel
*Assistant Examiner* — Peter G Leigh
(74) *Attorney, Agent, or Firm* — Kenealy Vaidya LLP

(57) ABSTRACT

A crimp terminal includes a wire connection portion including a bottom wall portion, and a pair of side wall portions. The wire connection portion includes a core wire crimping portion provided on one end side, and to be crimped onto a core wire of a wire, and a covering crimping portion provided on another end side, and to be crimped onto a covering of the wire, and integrally covers the core wire and the covering. In the core wire crimping portion before crimping, an interval between outer wall surfaces of the pair of side wall portions is widest at an end portion on the covering crimping portion side, and in the covering crimping portion before crimping, the interval is widest at an end portion on the core wire crimping portion side.

6 Claims, 21 Drawing Sheets

(51) Int. Cl.
*H01R 43/048* (2006.01)
*H01R 4/62* (2006.01)
*H01R 13/11* (2006.01)

(58) Field of Classification Search
USPC ..... 439/421, 882
See application file for complete search history.

(56) References Cited

U.S. PATENT DOCUMENTS

| | | | | |
|---|---|---|---|---|
| 9,039,467 | B2 * | 5/2015 | Seipel | H01R 4/185 439/877 |
| 9,293,838 | B2 * | 3/2016 | Sakaguchi | H01R 4/62 |
| 9,397,410 | B2 * | 7/2016 | Corman | H01R 4/185 |
| 9,502,785 | B2 * | 11/2016 | Schmidt | H01R 4/183 |
| 2013/0012077 | A1 | 1/2013 | Sato et al. | |
| 2013/0045644 | A1 * | 2/2013 | Aoki | H01R 4/183 439/878 |
| 2015/0140873 | A1 * | 5/2015 | Ito | H01R 4/62 439/877 |
| 2015/0318654 | A1 * | 11/2015 | Kawamura | H01R 43/048 439/877 |
| 2016/0013567 | A1 | 1/2016 | Sakaguchi | |

FOREIGN PATENT DOCUMENTS

| | | | |
|---|---|---|---|
| JP | 2010-55903 | A | 3/2010 |
| JP | 2011-216253 | A | 10/2011 |
| JP | 2012-69449 | A | 4/2012 |
| JP | 2014-183023 | A | 9/2014 |
| JP | 2016-81611 | A | 5/2016 |

* cited by examiner

XXV-XXV CROSS SECTION

CRIMP TERMINAL AND TERMINAL CRIMPING METHOD

CROSS-REFERENCE TO RELATED APPLICATION(S)

The present application claims priority to and incorporates by reference the entire contents of Japanese Patent Application No. 2016-201869 filed in Japan on Oct. 13, 2016.

BACKGROUND OF THE INVENTION

1. Field of the Invention

The present invention relates to a crimp terminal and a terminal crimping method.

2. Description of the Related Art

There has been conventionally a crimp terminal that integrally covers a core wire and a covering of a wire. For example, Japanese Patent Application Laid-open No. 2012-69449 discloses a technique of a crimp terminal that includes barrel pieces constituting a crimping portion that surrounds and crimps an exposed portion of an aluminum core wire, at both sides in a width direction, and performs crimping using the barrel pieces so that the crimping portion integrally surrounds a portion from a distal end side of a distal end of the aluminum core wire to a distal end side covering portion of a covering wire.

Here, if the crimp terminal fails to be appropriately crimped onto the wire, a failure may occur. For example, crimping strength may decrease, or a clearance gap may be generated. Such a failure causes a decrease in waterproof performance, and the like, which are not desirable.

SUMMARY OF THE INVENTION

The object of the present invention is to provide a crimp terminal that can be appropriately crimped onto a wire, and a terminal crimping method that can appropriately crimp a crimp terminal onto a wire.

In order to achieve the above mentioned object, a crimp terminal according to one aspect of the present invention includes a wire connection portion including a bottom wall portion, and a pair of side wall portions facing each other in a width direction of the bottom wall portion, and protruding from both ends in the width direction of the bottom wall portion, wherein the wire connection portion includes a core wire crimping portion provided on one end side in a longitudinal direction, and to be crimped onto a core wire of a wire, and a covering crimping portion provided on another end side in the longitudinal direction, and to be crimped onto a covering of the wire, and integrally covers the core wire and the covering by being crimped onto the wire, in the core wire crimping portion before crimping onto the wire, an interval between outer wall surfaces of the pair of side wall portions is widest at an end portion on the covering crimping portion side, and in the covering crimping portion before crimping onto the wire, an interval between outer wall surfaces of the pair of side wall portions is widest at an end portion on the core wire crimping portion side.

According to another aspect of the present invention, in the crimp terminal, it is preferable that in the core wire crimping portion before crimping onto the wire, an interval between outer wall surfaces of the pair of side wall portions becomes narrower toward an end portion on an opposite side of the covering crimping portion, and in the covering crimping portion before crimping onto the wire, an interval between outer wall surfaces of the pair of side wall portions becomes narrower toward an end portion on an opposite side of the core wire crimping portion.

According to still another aspect of the present invention, in the crimp terminal, it is preferable that in a cross section perpendicular to a longitudinal direction of the wire connection portion, a length of one side wall portion of the pair of side wall portions is longer than a length of another side wall portion.

According to still another aspect of the present invention, a terminal crimping method includes a crimping step of crimping a wire connection portion onto a core wire and a covering of a wire by a mold, the wire connection portion including a bottom wall portion, and a pair of side wall portions facing each other in a width direction of the bottom wall portion, and protruding from both ends in the width direction of the bottom wall portion, wherein the mold includes a first mold configured to support a bottom wall portion of the wire connection portion, and a second mold configured to come into contact with outer wall surfaces of the pair of side wall portions while relatively moving with respect to the first mold, and bend the pair of side wall portions inward to crimp the pair of side wall portions onto the wire, and in the crimping step, the second mold starts contact with the outer wall surfaces of the pair of side wall portions at a center portion in the longitudinal direction of the wire connection portion.

According to still another aspect of the present invention, in the terminal crimping method, it is preferable that a position at which the second mold starts contact with the outer wall surfaces of the pair of side wall portions is a position corresponding to an end portion of the covering of the wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A crimp terminal and a terminal crimping method according to an embodiment of the present invention will be described in detail below with reference to the drawings. In addition, the present invention is not limited by the embodiment. In addition, components in the following embodiment include the ones easily-conceived by those skilled in the art, or the ones that are substantially identical.

First Embodiment

Figure 12:
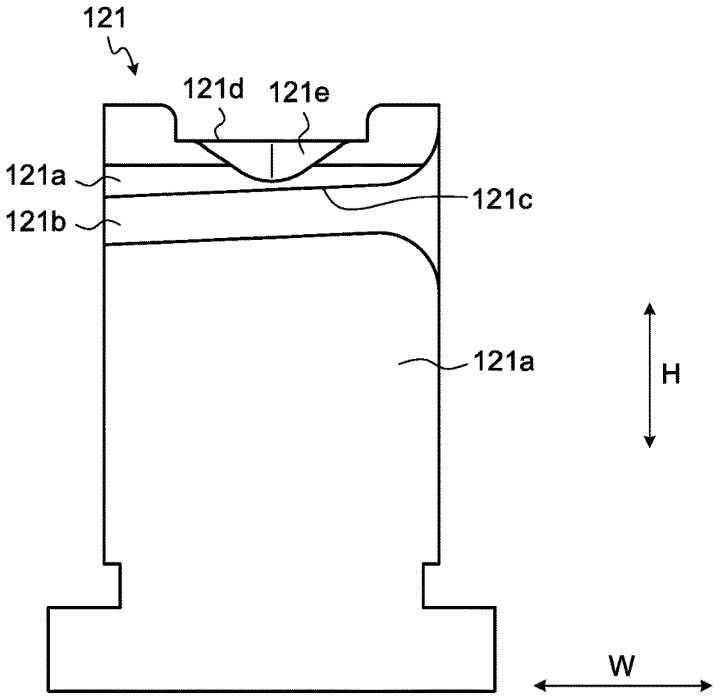
FIG. 12 is a rear view illustrating the terminal cutting member according to the first embodiment.
Figure 13:
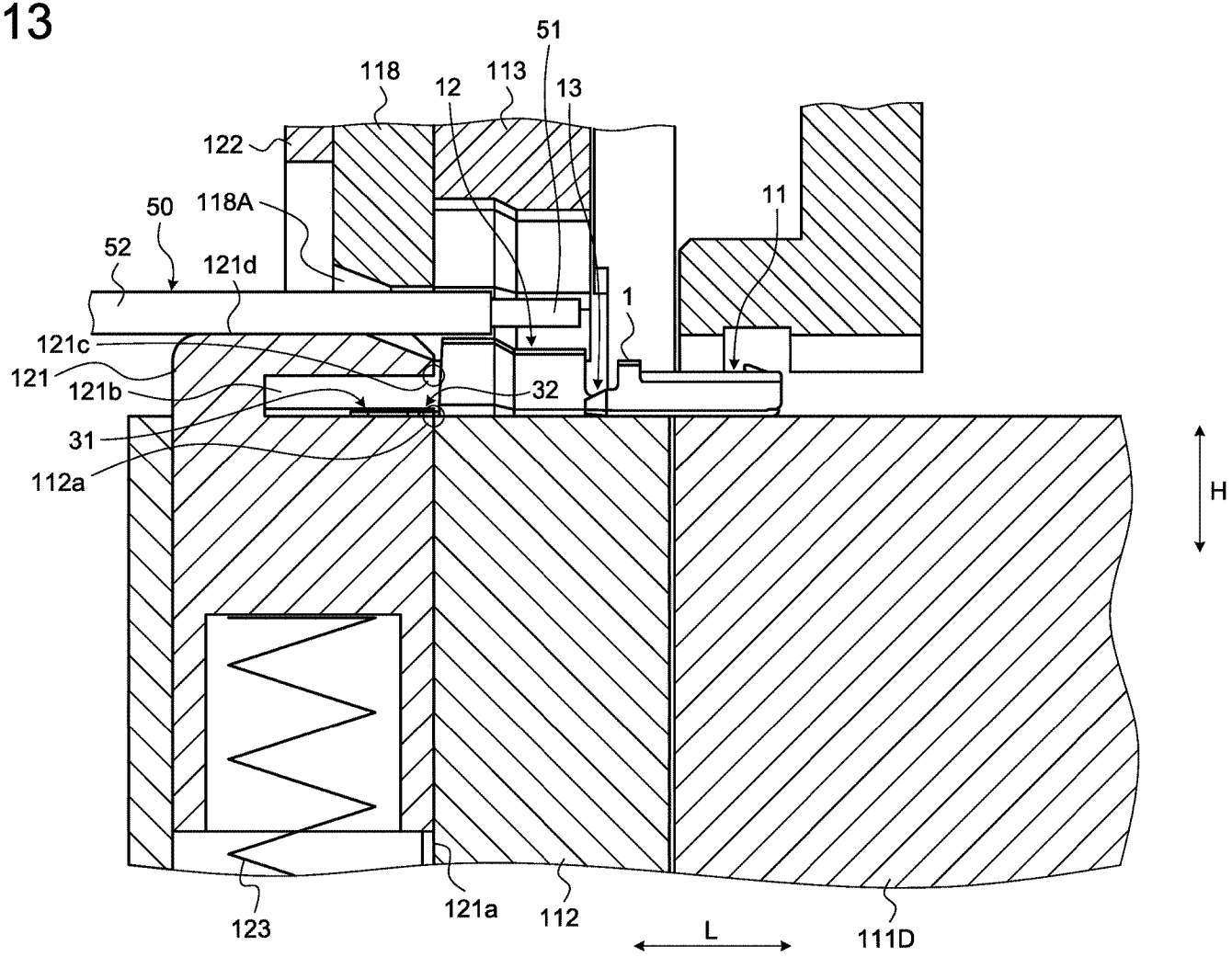
FIG. 13 is a cross-sectional view illustrating a state in which a wire and the crimp terminal are set in the terminal crimping apparatus according to the first embodiment.
Figure 14:
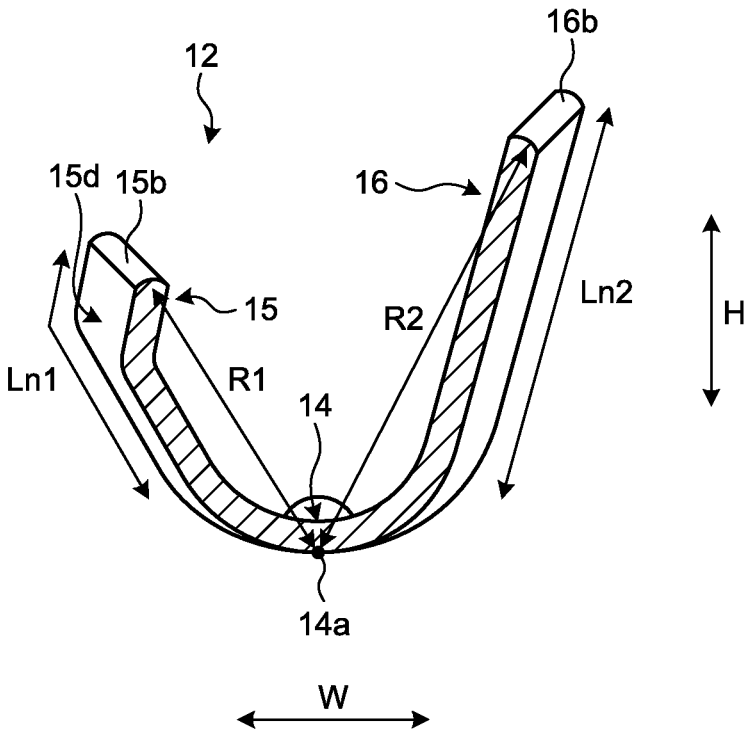
FIG. 14 is a cross-sectional view of the wire connection portion according to the first embodiment.

A first embodiment will be described with reference to FIGS. 1 to 23. The present embodiment relates to a crimp terminal and a terminal crimping method. Note that, FIG. 13 illustrates a XIII-XIII cross section in FIG. 9. FIG. 14 illustrates a XIV-XIV cross section in FIG. 15.

First of all, a crimp terminal 1 according to the present embodiment will be described. The crimp terminal 1 illustrated in FIG. 1 and the like is a terminal to be crimped onto a wire 50. The crimp terminal 1 is electrically-connected to another terminal (not illustrated) in a state of being integrated with the wire 50. A covering 52 at an end portion of the crimping target wire 50 is removed, and a core wire 51 is exposed by a predetermined length. The core wire 51 may be an aggregate of a plurality of wires, or may be a single wire such as a coaxial cable. By being crimped to the end portion of the wire 50, the crimp terminal 1 is electrically-connected to the exposed core wire 51.

The crimp terminal 1 includes a terminal fitting 10 and a water stop member 20. The terminal fitting 10 is a main portion of the crimp terminal 1. The terminal fitting 10 is formed of a conductive metal plate serving as a base material (e.g., copper plate, copper alloy plate). The terminal fitting 10 is formed into a predetermined shape that enables connection to the other terminal and the wire 50, through punching processing, bending processing, and the like that are performed on the base material. The terminal fitting 10 includes a terminal connection portion 11 and a wire connection portion 12. The terminal connection portion 11 is a portion to be electrically-connected to the other terminal. The wire connection portion 12 is a portion to be crimped onto the wire 50, and is electrically-connected to the core wire 51. A joint portion 13 is provided between the terminal connection portion 11 and the wire connection portion 12. In other words, the terminal connection portion 11 and the wire connection portion 12 are joined via the joint portion 13. The joint portion 13 includes side walls 13*a* and 13*a* that link side walls 11*a* and 11*a* of the terminal connection portion 11 and barrel piece portions 15 and 16 being side walls of the wire connection portion 12. One side wall 13*a* links one side wall 11*a* and a first barrel piece portion 15, and the other side wall 13*a* links the other side wall 11*a* and a second barrel piece portion 16. A height of the side walls 13*a* is lower than heights of the barrel piece portions 15 and 16, and the side walls 11*a*. More specifically, the height of the side walls 13*a* becomes lower from the terminal connection portion 11 toward the wire connection portion 12.

The terminal fitting 10 may be a male terminal or a female terminal. When the terminal fitting 10 is a male terminal, the terminal connection portion 11 is formed into a male type, and when the terminal fitting 10 is a female terminal, the terminal connection portion 11 is formed into a female type.

In the description of the crimp terminal 1, a direction in which the crimp terminal 1 is connected to the other terminal, that is, a direction in which the crimp terminal 1 is inserted into the other terminal will be referred to as a first direction L. The first direction L is a longitudinal direction of the crimp terminal 1. A parallel arrangement direction of the crimp terminals 1 will be referred to as a second direction W. As described later, the parallel arrangement direction is a direction in which the crimp terminals 1 are arranged in parallel in a terminal chain member 30, and is a width direction of the crimp terminal 1. In the crimp terminal 1, a direction perpendicular to both of the first direction L and the second direction W will be referred to as a third direction H. The third direction H is a height direction of the crimp terminal 1.

Figure 1:
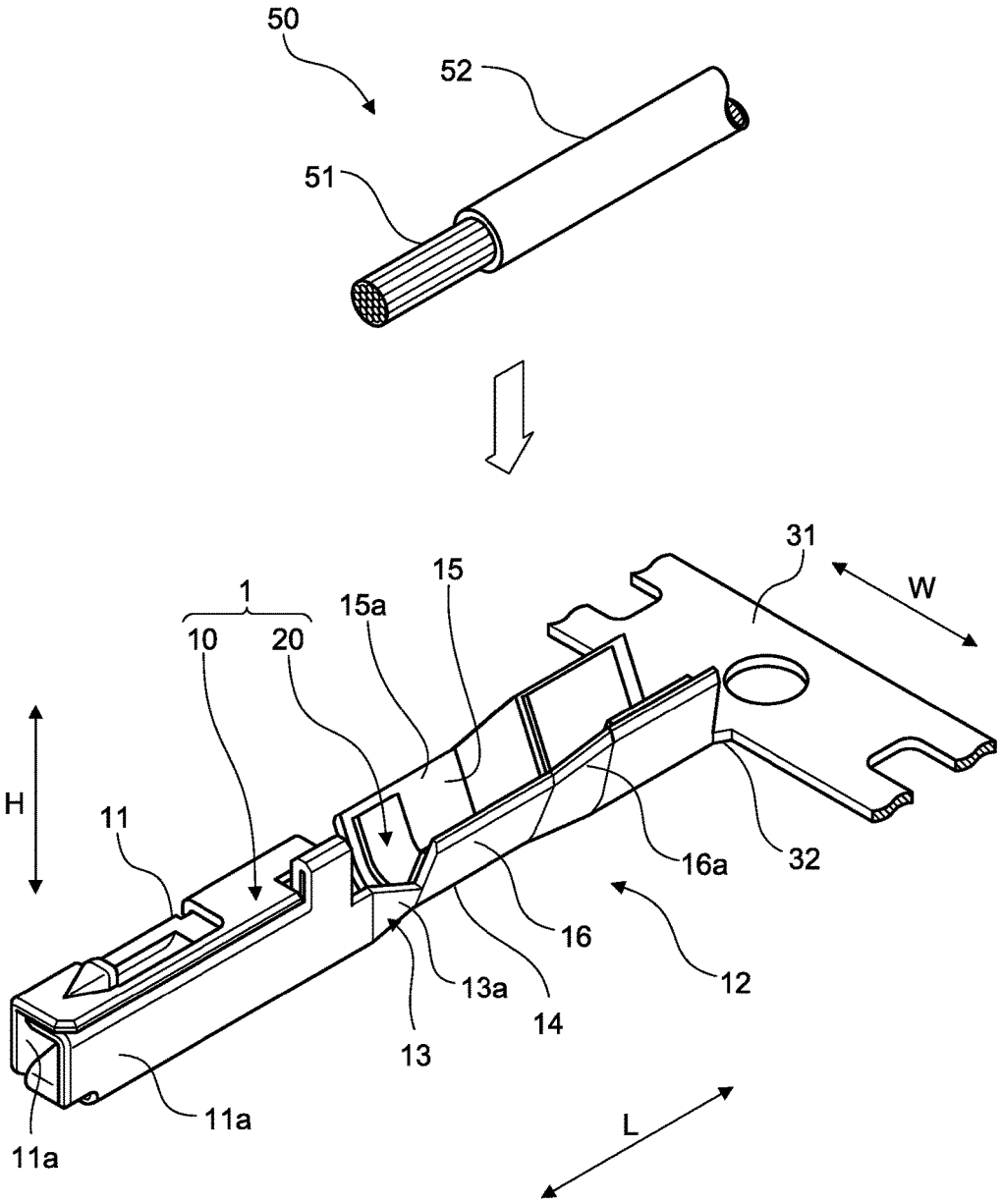
FIG. 1 is a perspective view illustrating a state before crimping of a crimp terminal according to a first embodiment.
Figure 2:
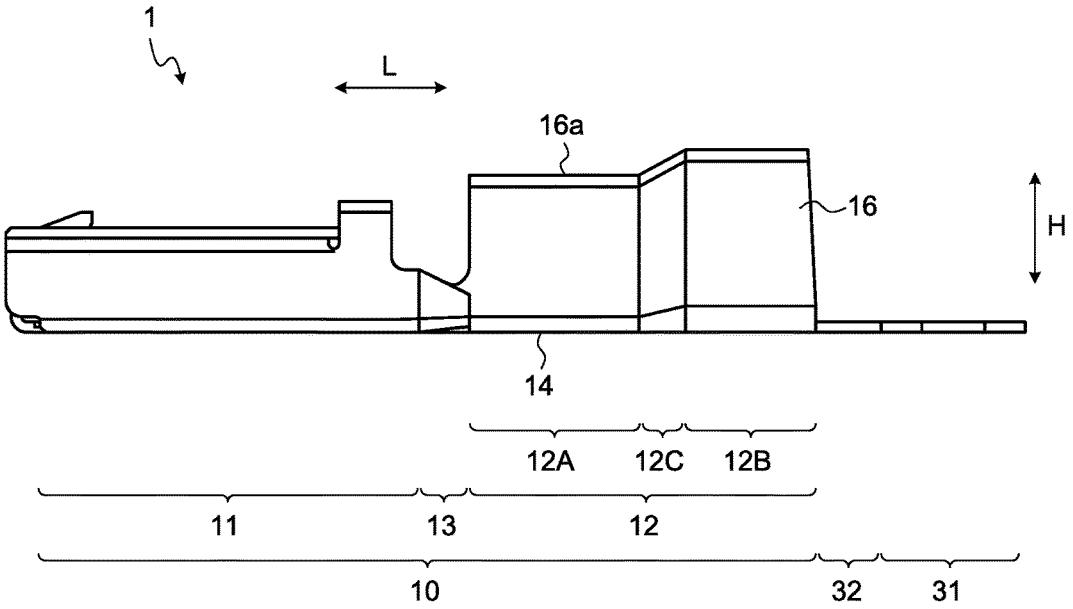
FIG. 2 is aside view illustrating a state before crimping of the crimp terminal according to the first embodiment.

In a forming process, the crimp terminal 1 is formed into a flat plate shape, and from this state, in a terminal connection portion shaping process, the terminal connection portion 11 is formed into a tubular shape as illustrated in FIG. 1. In the terminal connection portion shaping process, the bending processing and the like are performed on the terminal connection portion 11. The terminal connection portion 11 of the present embodiment is formed into a tubular shape having a rectangular cross-sectional shape. In a wire connection portion shaping process, the wire connection portion 12 is formed so as to have a U-shaped cross-sectional shape. In the wire connection portion shaping process, the bending processing and the like are performed on the wire connection portion 12. In addition, the water stop member 20 is attached to the wire connection portion 12 in an attaching process. The attaching process may be executed before the wire connection portion shaping process, or may be executed after the wire connection portion shaping process.

Figure 6:
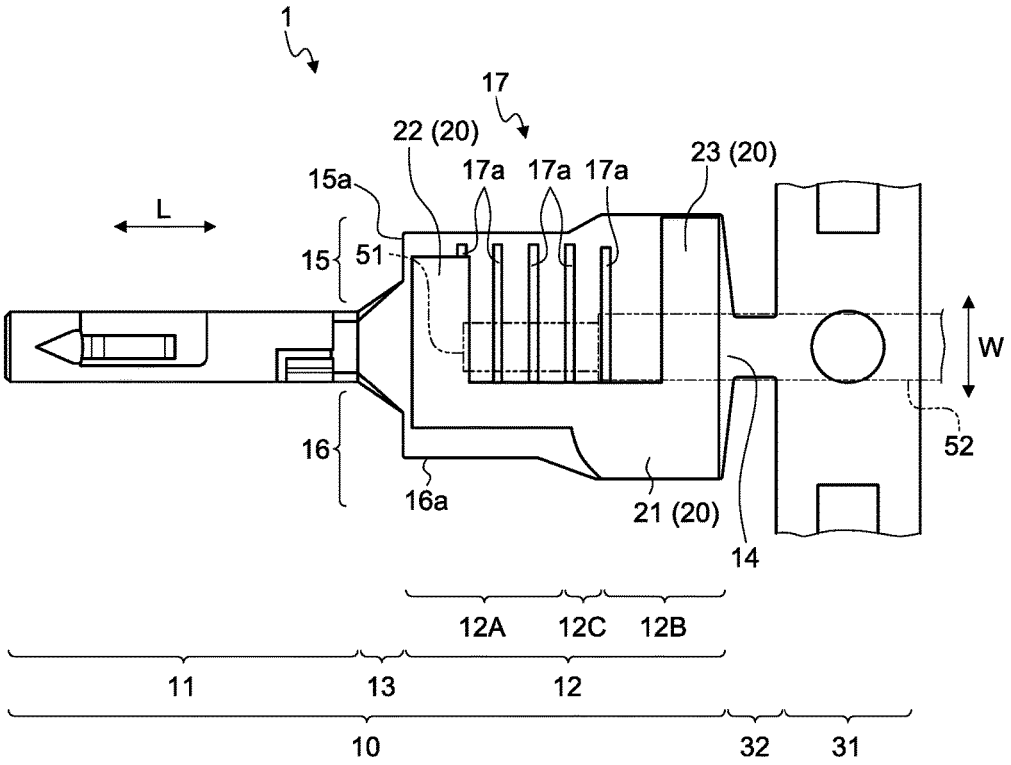
FIG. 6 is a plan view illustrating a state in which a water stop member is attached in the crimp terminal according to the first embodiment.

As illustrated in FIGS. 1 and 6, the wire connection portion 12 includes a bottom portion 14, the first barrel piece portion 15, and the second barrel piece portion 16. The bottom portion 14 is a region serving as a bottom wall of the wire connection portion 12 formed into the U-shape. In crimping processing, the end portion of the wire 50 is placed on the bottom portion 14. The first barrel piece portion 15 and the second barrel piece portion 16 are regions serving as side walls of the wire connection portion 12 formed into the U-shape. The first barrel piece portion 15 and the second barrel piece portion 16 are connected to end portions in the second direction W of the bottom portion 14. The first barrel piece portion 15 and the second barrel piece portion 16 protrude from the end portions in the width direction of the bottom portion 14, toward directions intersecting with the width direction. In the wire connection portion 12 formed into the U-shape, when the end portion of the wire 50 is placed on the bottom portion 14, the first barrel piece portion 15 and the second barrel piece portion 16 surround the wire 50 from both sides in the second direction W.

Lengths from roots on the bottom portion 14 side to end surfaces of distal ends 15*a* and 16*a* of the first barrel piece portion 15 and the second barrel piece portion 16 may be equal to each other, or one length may be longer than the other length. In the crimp terminal 1 of the present embodiment, the length from the root to the distal end 16*a* of the second barrel piece portion 16 is longer than the length from the root to the distal end 15*a* of the first barrel piece portion 15. For example, the first barrel piece portion 15 and the second barrel piece portion 16 are wound around the wire 50 while overlapping each other. In the present embodiment, the second barrel piece portion 16 overlaps on the outside of the first barrel piece portion 15. Caulking referred to as so-called B crimping may be performed on the first barrel piece portion 15 and the second barrel piece portion 16. In the B crimping, both of the first barrel piece portion 15 and the second barrel piece portion 16 are bent toward the bottom portion 14 side, and caulked so that the distal ends 15*a* and 16*a* are pressed against the wire 50. Because the crimp terminal 1 of the present embodiment is provided with the water stop member 20 to be described later, the former caulking processing is employed.

The end portion of the wire 50 is inserted into a U-shaped inner space from a U-shaped opening portion of the wire connection portion 12, that is, from a clearance gap between the distal ends 15*a* and 16*a*. The wire connection portion 12 is formed so that the end portion of the wire 50 can be easily inserted. More specifically, in the wire connection portion 12, a distance in the second direction W between the first barrel piece portion 15 and the second barrel piece portion 16 widens from the bottom portion 14 side toward the end surfaces of the distal ends 15*a* and 16*a*.

As illustrated in FIGS. 2 to 6, in the first barrel piece portion 15 and the second barrel piece portion 16, a joint crimping portion 12C interposes between a core wire crimping portion 12A and a covering crimping portion 12B. Each of the first barrel piece portion 15 and the second barrel piece portion 16 is one piece portion in which the crimping portions 12A, 12C, and 12B are consecutively arranged in the first direction L in this order.

The core wire crimping portion 12A is a region to be crimped onto the core wire 51 at the distal end of the wire 50. The core wire crimping portion 12A is a region closest to the joint portion 13 in each of the barrel piece portions 15 and 16. The covering crimping portion 12B is a region to be crimped onto an end portion of the covering 52. The covering crimping portion 12B is a region positioned on the farthest side from the joint portion 13 side in each of the barrel piece portions 15 and 16. The joint crimping portion 12C is a region linking the core wire crimping portion 12A and the covering crimping portion 12B. The joint crimping portion 12C is crimped onto a boundary portion between the core wire 51 and the covering 52 of the wire 50. By being crimped onto the wire 50, the wire connection portion 12 integrally covers the core wire 51 and the covering 52.

Figure 5:
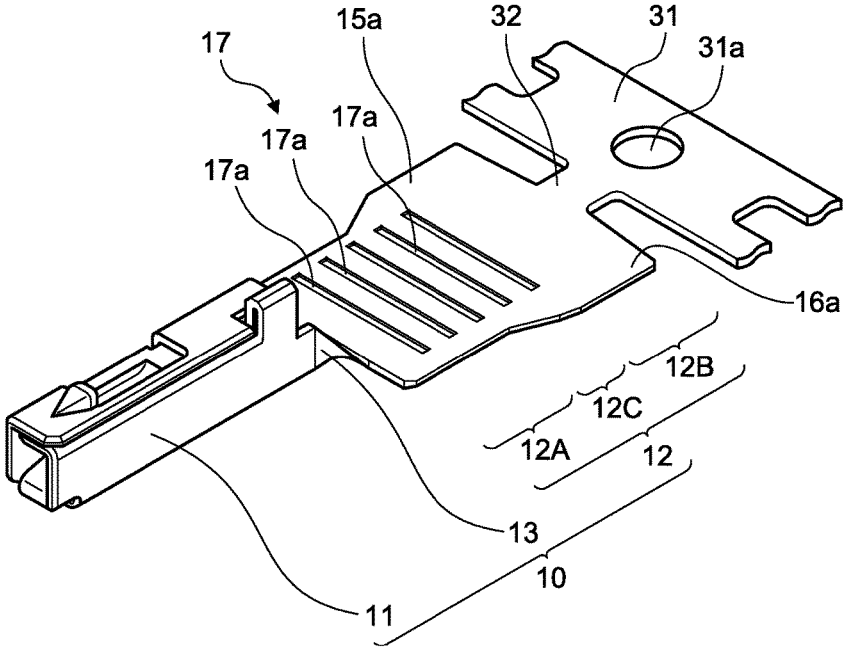
FIG. 5 is a perspective view illustrating a state before bending processing of a wire connection portion is performed in the crimp terminal according to the first embodiment.

As illustrated in FIGS. 5 and 6, a serration region 17 is provided on an inner wall surface of the wire connection portion 12, that is, on a wall surface on the side covering the wire 50. The serration region 17 is a core wire holding region for holding the core wire 51. The serration region 17 is a region on the inner wall surface of the wire connection portion 12 that includes a portion to be wound around the core wire 51. A plurality of recessed portions, a plurality of projection portions, or combinations of recessed portions and projection portions are arranged on the serration region 17. The recessed portions and the projection portions increase a contact area between the wire connection portion 12 and the core wire 51 to enhance the strength of adhesion therebetween. The serration region 17 of the present embodiment is an rectangular region, and a plurality of recessed portions 17*a* are formed at positions different from each other in the first direction L.

Here, ingress of water between the core wire 51 and the wire connection portion 12 crimped onto the core wire 51 is not preferable. For example, when the metal material of the core wire 51 and the metal material of the wire connection portion 12 have different ionization tendencies, corrosion may occur. As an example, when the material of the core wire 51 is aluminum, and the material of the wire connection portion 12 is copper, the core wire 51 may corrode. The crimp terminal 1 of the present embodiment is provided with the water stop member 20. The water stop member 20 suppresses ingress of water between the wire connection portion 12 and the core wire 51.

For example, the water stop member 20 is a member formed into a sheet mainly containing adhesive such as acrylic adhesive. As the water stop member 20 of the present embodiment, an adhesive sheet being formed of sheet-like nonwoven cloth saturated with adhesive, and having an adhesive effect on the both sides is used.

For example, the water stop member 20 is attached onto the inner wall surface of the flat-plate-shaped wire connection portion 12 illustrated in FIG. 5. As illustrated in FIG. 6, the water stop member 20 is formed into a predetermined shape, and includes a first water stop portion 21, a second water stop portion 22, and a third water stop portion 23. After the completion of crimping, the first water stop portion 21 stops water ingress into an overlapping portion of the first barrel piece portion 15 and the second barrel piece portion 16. More specifically, the first water stop portion 21 forms a water stop region between the barrel piece portions 15 and 16 by being sandwiched between the first barrel piece portion 15 and the second barrel piece portion 16 overlapping each other. The first water stop portion 21 of the present embodiment is disposed in the second barrel piece portion 16, and extends in the first direction L.

The second water stop portion 22 stops water ingress into a portion on the terminal connection portion 11 side from the distal end of the core wire 51. The second water stop portion 22 is disposed at an end portion on the terminal connection portion 11 side of the wire connection portion 12, and extends in the second direction W. At least part of the second water stop portion 22 is desirably provided in a region in which the core wire 51 is placed. For example, the second water stop portion 22 forms a water stop region in a clearance gap between the barrel piece portions 15 and 16 by being sandwiched between the overlapping barrel piece portions 15 and 16. The second water stop portion 22 can also block a clearance gap provided on the terminal connection portion 11 side from the distal end of the core wire 51, by overlapping each other in a crimping process. The second water stop portion 22 suppresses ingress of water between the wire connection portion 12 and the core wire 51 from the terminal connection portion 11 side.

The third water stop portion 23 suppresses ingress of water from a clearance gap between the wire connection portion 12 and the covering 52. The third water stop portion 23 is disposed at an end portion on an opposite side of the terminal connection portion 11 side of the wire connection portion 12, and extends in the second direction W. The third water stop portion 23 forms a water stop region between the covering 52 and the wire connection portion 12 by being sandwiched between the covering 52 and the wire connection portion 12.

Through a press process performed on one metal plate serving as a base material, the above-described terminal fitting 10 is processed into a configuration having the flat-plate-shaped wire connection portion 12 illustrated in FIG. 5. In the subsequent water stop member attaching process, the water stop member 20 is attached to the flat-plate-shaped wire connection portion 12. After that, in the terminal fitting 10, in a bending process, the terminal connection portion 11 is formed, and the U-shaped wire connection portion 12 is formed.

Figure 7:
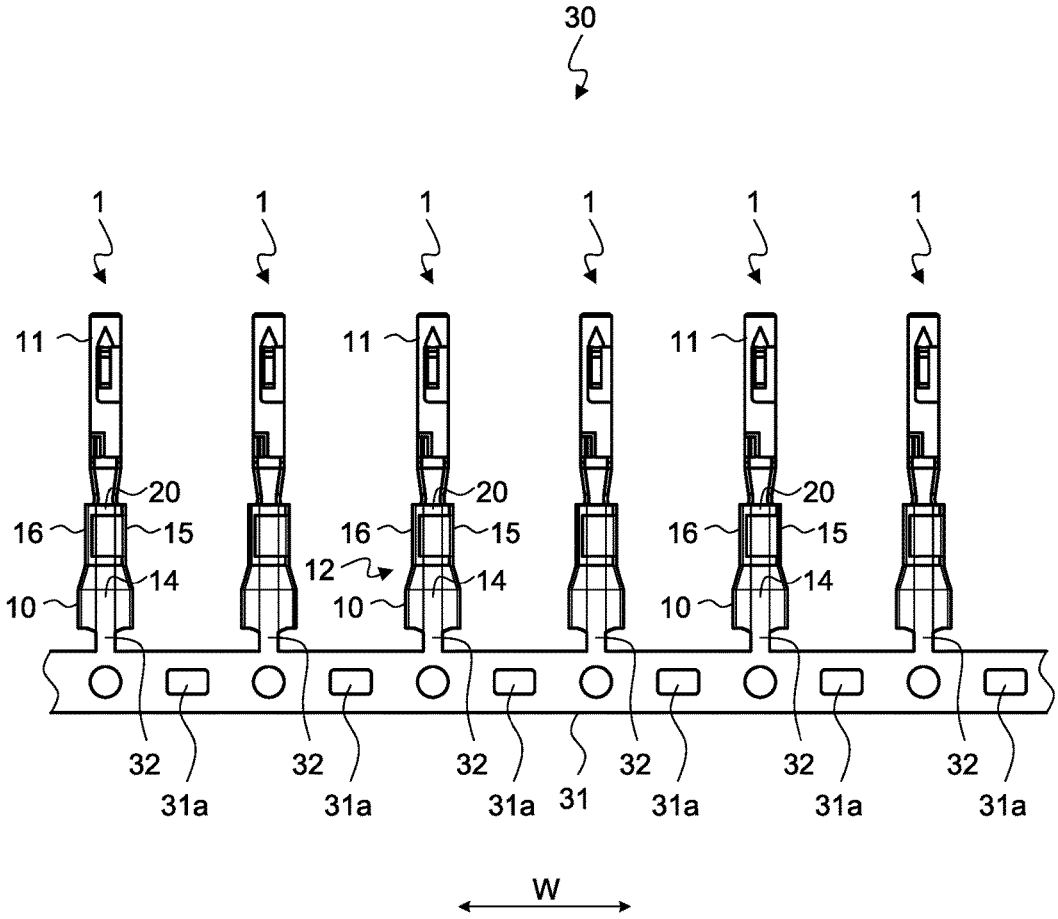
FIG. 7 is a plan view illustrating a terminal chain member according to the first embodiment.

In the present embodiment, the terminal chain member 30 illustrated in FIG. 7 is formed through the press process and the bending process. The terminal chain member 30 is obtained by chaining a plurality of the crimp terminals 1, and is formed of one metal plate. The terminal chain member 30 is supplied to a terminal crimping apparatus 100. The terminal crimping apparatus 100 executes the crimping process and a terminal cutting process on the terminal chain member 30. The crimping process is a process of caulking and crimping the crimp terminal 1 of the terminal chain member 30 onto the wire 50. The terminal cutting process is a process of cutting off the crimp terminal 1 caulked to the wire 50, from the terminal chain member 30.

The terminal chain member 30 is an aggregate of the crimp terminals 1. The terminal chain member 30 includes a joint piece 31, the plurality of crimp terminals 1, and a plurality of link portions 32. The joint piece 31, the crimp terminals 1, and the link portions 32 are integrally formed of the same base material. In the terminal chain member 30, the crimp terminals 1 are oriented in the same direction, and arranged in parallel at equal intervals. In the terminal chain member 30, one end portions of the respective crimp terminals 1 are linked to each other by the joint piece 31. For example, the shape of the joint piece 31 is a thin and long oblong plate shape. The joint piece 31 extends in the second direction W. The wire connection portions 12 are connected to the joint piece 31 via the link portions 32. More specifically, the link portions 32 link the end portions on the opposite side of the terminal connection portion 11 side of the bottom portions 14 to the joint piece 31.

A plurality of terminal feed holes 31*a* are formed in the joint piece 31. The terminal feed holes 31*a* are arranged at equal intervals in a feed direction of the terminal chain member 30. The terminal feed holes 31*a* are through-holes penetrating through the joint piece 31 in a plate thickness direction. The crimp terminals 1 are positioned by the terminal feed holes 31*a* on a crimping device 102 to be described later. The terminal chain member 30 is set into the terminal crimping apparatus 100 in a state of being wound up in a reel shape.

Figure 8:
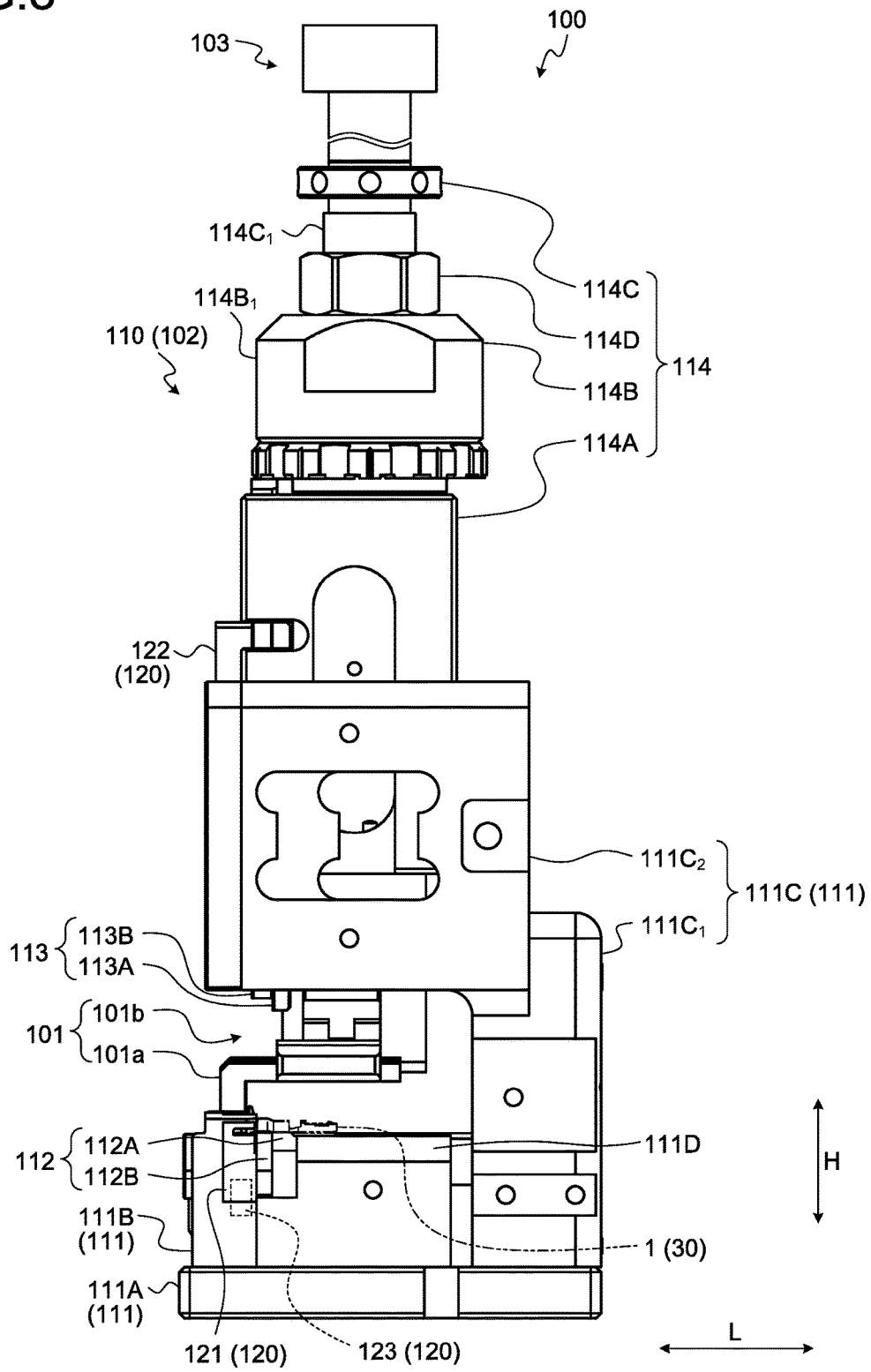
FIG. 8 is a side view of a terminal crimping apparatus according to the first embodiment.
Figure 9:
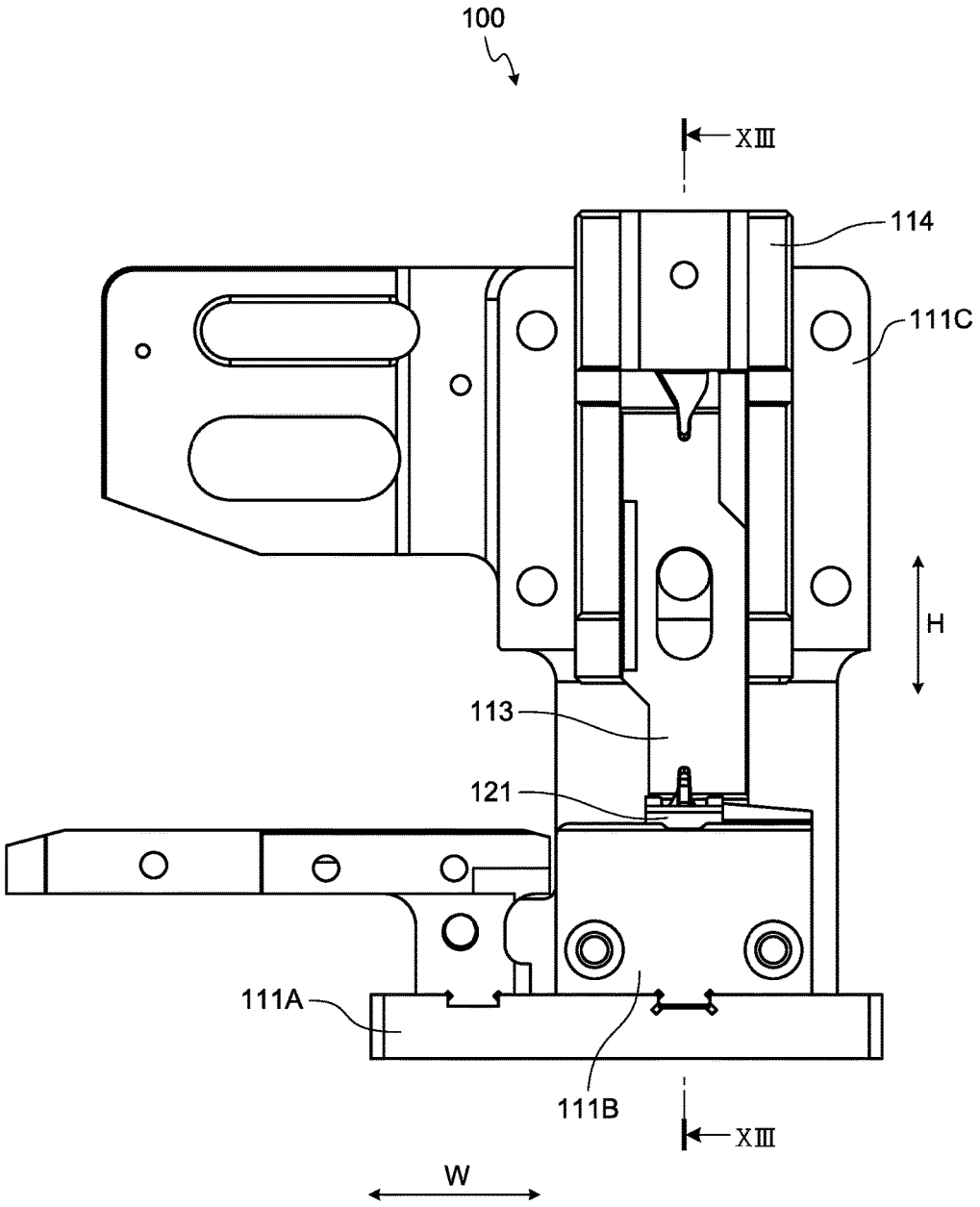
FIG. 9 is a front view of the terminal crimping apparatus according to the first embodiment.

As illustrated in FIG. 8, the terminal crimping apparatus 100 includes a terminal supply device 101, the crimping device 102, and a driving device 103. The terminal crimping apparatus 100 is an apparatus referred to as an applicator in this technical field. The terminal supply device 101 is a device that supplies the crimp terminal 1 to a predetermined crimping position. The crimping device 102 is a device that crimps the crimp terminal 1 onto the wire 50 at the predetermined crimping position. The driving device 103 is a device that operates the terminal supply device 101 and the crimping device 102.

The terminal supply device 101 pulls out the terminal chain member 30 wound up in a reel shape, sequentially from the outer peripheral side. The terminal supply device 101 supplies the crimp terminals 1 of the pulled-out terminal chain member 30 to crimping positions, sequentially from the forefront side. When the forefront crimp terminal 1 is crimped onto the wire 50, and cut off from the joint piece 31, the terminal supply device 101 supplies the crimp terminal 1 that newly comes at the forefront, to the crimping position. Each time the crimping process and the cutting process of one crimp terminal 1 are completed, the terminal supply device 101 performs a supply operation to supply the next crimp terminal 1 to the crimping position.

The terminal supply device 101 includes a terminal feed member 101*a* and a power transmission mechanism 101*b*. The terminal feed member 101*a* includes a protruding portion to be inserted into the terminal feed hole 31*a* of the joint piece 31. The terminal feed member 101*a* moves the terminal chain member 30 in the feed direction in a state in which the protruding portion is inserted into the terminal feed hole 31*a*. The power transmission mechanism 101*b* operates the terminal feed member 101*a* in conjunction with a crimping operation performed by the crimping device 102 (up-and-down movement of a ram 114A or the like that is to be described later). The terminal supply device 101 supplies the crimp terminal 1 to the crimping position by moving the terminal feed member 101*a* in the up-down direction and the feed direction in conjunction with the crimping operation of the crimping device 102.

The crimping device 102 executes the crimping process of crimping the supplied the crimp terminal 1 onto the wire 50, and a cutting process of cutting off the crimp terminal 1 from the joint piece 31. The crimping device 102 includes a crimping machine 110 and a terminal cutting mechanism 120.

The crimping machine 110 is a device that crimps the crimp terminal 1 onto the wire 50 by caulking the crimp terminal 1 to the end portion of the wire 50. The crimping machine 110 of the present embodiment crimps the crimp terminal 1 onto the wire 50 by caulking the first barrel piece portion 15 and the second barrel piece portion 16 of the crimp terminal 1 so as to be wound around the core wire 51 and the covering 52 of the wire 50. The crimping machine 110 includes a frame 111, a first mold 112, a second mold 113, and a power transmission mechanism 114.

The frame 111 includes a base 111A, an anvil supporting member 111B, a transmission portion supporting member 111C, and a support base 111D. The base 111A is a member serving as a basis of the terminal crimping apparatus 100. The base 111A is fixed to a placement base on which the terminal crimping apparatus 100 is to be placed. The anvil supporting member 111B, the transmission portion supporting member 111C, and the support base 111D are fixed onto the base 111A.

The transmission portion supporting member 111C is disposed on the rear side (right side on a paper surface in FIG. 8) and on the upper side (upper side on the paper surface in FIG. 8) of the anvil supporting member 111B. More specifically, the transmission portion supporting member 111C includes a standing portion 111$C_1$ and a ram supporting portion 111$C_2$. The standing portion 111$C_1$ is disposed on the rear side of the anvil supporting member 111B, and is vertically standing upward from the base 111A. The ram supporting portion 111$C_2$ is held on the upper side of the standing portion 111$C_1$. The ram supporting portion 111$C_2$ is a supporting portion that supports the ram 114A to be described later. The ram supporting portion 111$C_2$ is disposed on the upper side of the anvil supporting member 111B, at a predetermined interval from the anvil supporting member 111B. The support base 111D is a base that supports the terminal connection portion 11 of the crimp terminal 1. A height position of the top surface of the support base 111D is a position substantially similar to a height position of the top surface of the first mold 112.

Figure 10:
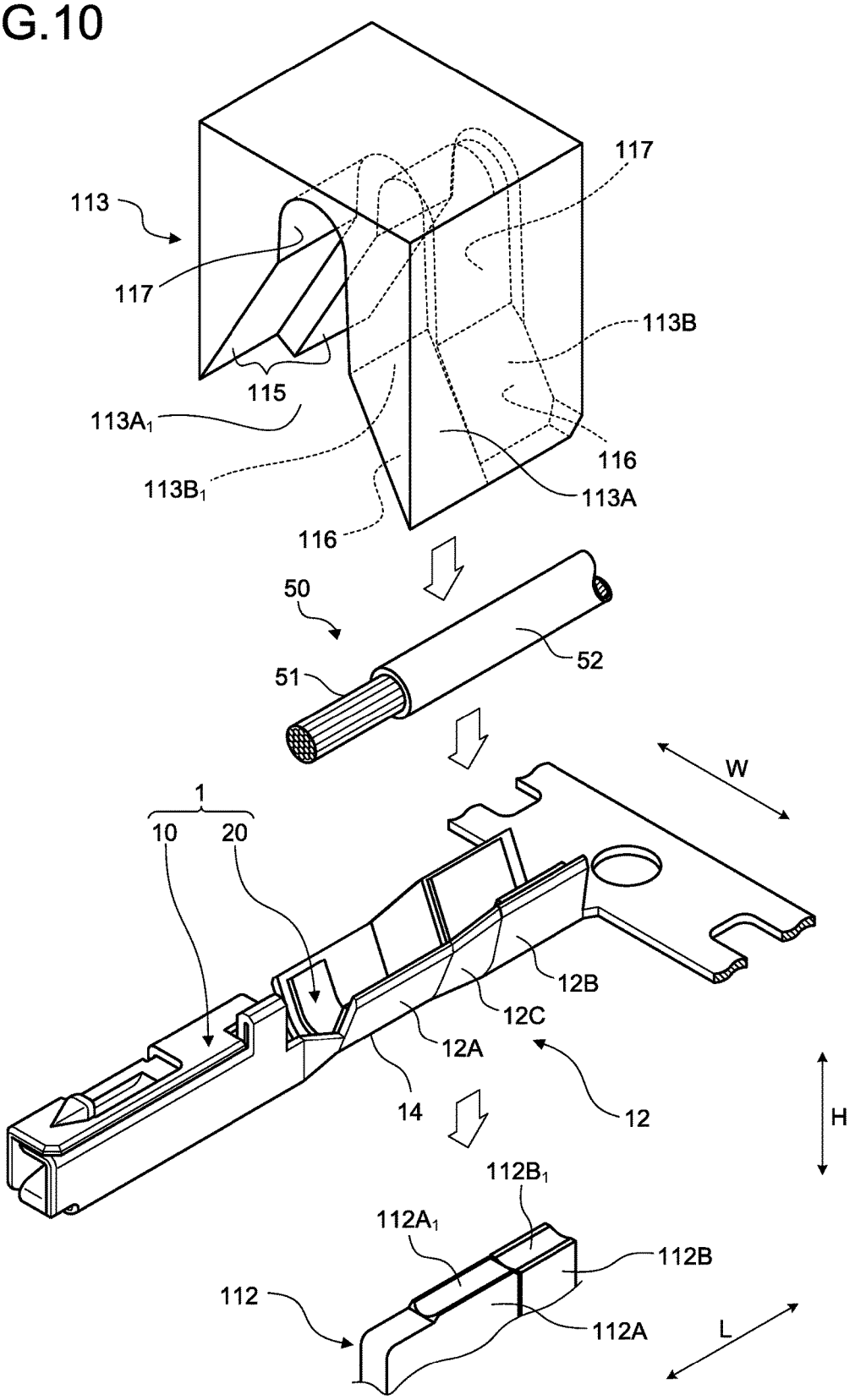
FIG. 10 is a perspective view illustrating first and second molds according to the first embodiment.

The first mold 112 and the second mold 113 form a pair. The first mold 112 and the second mold 113 are disposed at an interval in the up-down direction. As illustrated in FIG. 10, the first mold 112 and the second mold 113 crimp the crimp terminal 1 onto the wire 50 by sandwiching the crimp terminal 1 and the wire 50 therebetween. The first mold 112 is a mold that supports the crimp terminal 1 from the lower side. The first mold 112 is formed of two lower molds, and includes a first anvil 112A serving as a first lower mold, and a second anvil 112B serving as a second lower mold. For example, the first anvil 112A and the second anvil 112B are integrally formed. The second mold 113 is disposed on the upper side of the first mold 112. The second mold 113 is formed of two upper molds, and includes a first crimper 113A serving as a first upper mold, and a second crimper 113B serving as a second upper mold.

The first anvil 112A and the first crimper 113A oppose each other in the up-down direction. The first anvil 112A and the first crimper 113A crimp the core wire crimping portion 12A. More specifically, the first anvil 112A and the first crimper 113A wind the U-shaped core wire crimping portion 12A around the core wire 51 of the wire 50 to crimp the core wire crimping portion 12A onto the core wire 51, by narrowing a distance therebetween.

The second anvil 112B and the second crimper 113B oppose each other in the up-down direction. The second anvil 112B and the second crimper 113B crimp the covering crimping portion 12B. More specifically, the second anvil 112B and the second crimper 113B wind the U-shaped covering crimping portion 12B around the covering 52 to crimp the covering crimping portion 12B onto the covering 52, by narrowing a distance therebetween.

In the crimping process, by transmitting power to the power transmission mechanism 114, the driving device 103 narrows a distance between the first mold 112 and the second mold 113 to crimp the wire connection portion 12 onto the wire 50. On the other hand, when the crimping process is completed, the driving device 103 widens the distance between the first mold 112 and the second mold 113. In the crimping device 102 of the present embodiment, a distance between the pair of molds 112 and 113 changes by the second mold 113 moving up and down with respect to the first mold 112.

Note that, in the first mold 112, the first anvil 112A and the second anvil 112B may be separately formed, and in the second mold 113, the first crimper 113A and the second crimper 113B may be separately formed. In this case, the driving device 103 and the power transmission mechanism 114 may be configured to separately move the first crimper 113A and the second crimper 113B up and down.

The power transmission mechanism 114 transmits power output from the driving device 103, to the first crimper 113A and the second crimper 113B. As illustrated in FIG. 8, the power transmission mechanism 114 includes the ram 114A, a ram bolt 114B, and a shank 114C.

The ram 114A is a movable member supported so as to be movable up and down with respect to the ram supporting portion 111$C_2$. The second mold 113 is fixed to the ram 114A. Thus, the first crimper 113A and the second crimper 113B move up and down integrally with the ram 114A, with respect to the ram supporting portion 111$C_2$. For example, the shape of the ram 114A is a parallelepiped. A female screw portion (not illustrated) is formed in the ram 114A. The female screw portion is formed on the inner circumferential surface of a hole in the up-down direction that is formed from an inner side of the ram 114A toward an upper end surface.

The ram bolt 114B includes a male screw portion (not illustrated), and the male screw portion is screwed with the female screw portion of the ram 114A. Thus, the ram bolt 114B moves up and down integrally with the ram 114A, with respect to the ram supporting portion 111$C_2$. In addition, the ram bolt 114B includes a bolt head portion 114$B_1$ disposed on the upper side of the male screw portion. A female screw portion (not illustrated) is formed in the bolt head portion 114$B_1$. The female screw portion of the bolt head portion 114$B_1$ is formed on the inner circumferential surface of a hole in the up-down direction that is formed from an inner side of the bolt head portion 114$B_1$ toward an upper end surface.

The shank 114C is a cylindrically-shaped hollow member, and includes a male screw portion 114$C_1$ and a connection portion (not illustrated) at each end portion. The male screw portion 114$C_1$ of the shank 114C is formed on the lower side of the hollow member, and is screwed with the female screw portion of the bolt head portion 114$B_1$ of the ram bolt 114B. Thus, the shank 114C moves up and down integrally with the ram 114A and the ram bolt 114B, with respect to the ram supporting portion 111$C_2$. The connection portion of the shank 114C is connected to the driving device 103.

The driving device 103 includes a driving source (not illustrated), and a power conversion mechanism (not illustrated) that converts drive power of the driving source into power in the up-down direction. The connection portion of the shank 114C is joined to an output shaft of the power conversion mechanism. Thus, the first crimper 113A and the second crimper 113B move up and down integrally with the ram 114A, the ram bolt 114B, and the shank 114C, with respect to the ram supporting portion 111$C_2$, according to an output of the driving device 103 (output of the power conversion mechanism). As the driving source of the driving device 103, an electrical actuator of an electrical motor or the like, a hydraulic actuator of a hydraulic cylinder or the like, an air pressure actuator of an air cylinder or the like, and the like can be applied.

A relative position in the up-down direction of the first crimper 113A with respect to the first anvil 112A, and a relative position in the up-down direction of the second crimper 113B with respect to the second anvil 112B can be changed by adjusting a screw amount of the female screw portion of the bolt head portion 114$B_1$ and the male screw portion 114$C_1$ of the shank 114C. A nut 114D is screwed with the male screw portion 114$C_1$ of the shank 114C on the upper side of the ram bolt 114B. Thus, the nut 114D functions as a so-called locknut together with the female screw portion of the bolt head portion 114$B_1$. By being tightened toward the ram bolt 114B side after the completion of the adjustment of the above-described relative positions, the nut 114D can fix the first crimper 113A and the second crimper 113B at the relative positions.

As illustrated in FIG. 10, recessed surfaces 112$A_1$ and 112$B_1$ recessed downward are formed at the respective upper distal ends of the first anvil 112A and the second anvil 112B. The respective recessed surfaces 112$A_1$ and 112$B_1$ are formed so as to have arc-shaped cross sections, in accordance with the respective shapes of the bottom portion 14 of the U-shaped core wire crimping portion 12A and the U-shaped covering crimping portion 12B. In the crimping machine 110, the recessed surfaces 112$A_1$ and 112$B_1$ each serve as a crimping position. In the crimp terminal 1 supplied with the bottom portion 14 facing downward, the bottom portion 14 of the core wire crimping portion 12A is placed on the recessed surface 112$A_1$ of the first anvil 112A, and the bottom portion 14 of the covering crimping portion 12B is placed on the recessed surface 112$B_1$ of the second anvil 112B. The first mold 112 is supported by the anvil supporting member 111B in a state in which the recessed surfaces 112$A_1$ and 112$B_1$ are exposed upward.

As illustrated in FIG. 10, recessed portions 113$A_1$ and 113$B_1$ recessed upward are respectively formed in the first crimper 113A and the second crimper 113B. The recessed portions 113$A_1$ and 113$B_1$ are disposed to face the respective recessed surfaces 112$A_1$ and 112$B_1$ of the first anvil 112A and the second anvil 112B in the up-down direction. Each of the recessed portions 113$A_1$ and 113$B_1$ includes first and second wall surfaces 115 and 116, and a third wall surface 117. The first wall surface 115 and the second wall surface 116 oppose each other in the second direction W. The third wall surface 117 connects the upper ends of the first and second wall surfaces 115 and 116. While bringing the first to third wall surface 115, 116, and 117 into contact with the first barrel piece portion 15 and the second barrel piece portion 16, each of the recessed portions 113$A_1$ and 113$B_1$ winds the first barrel piece portion 15 and the second barrel piece portion 16 around the end portion of the wire 50 to caulk thereonto. Each of the recessed portions 113$A_1$ and 113$B_1$ is formed so as to be able to perform such a caulking operation.

The crimp terminal 1 having been subjected to the crimping processing in the crimping machine 110 is cut off from the joint piece 31 by the terminal cutting mechanism 120. The terminal cutting mechanism 120 cuts the link portion 32 of the crimp terminal 1 supplied to the crimping position by sandwiching the link portion 32 between two terminal cutting portions, and performs the cut off in conjunction with the progress of the crimping process. As illustrated in FIG. 8, the terminal cutting mechanism 120 is disposed on the front side (the left side in on the paper surface in FIG. 8) of the second anvil 112B. The terminal cutting mechanism 120 includes a terminal cutting member 121, a pressing member 122, and an elastic member 123.

Figure 11:
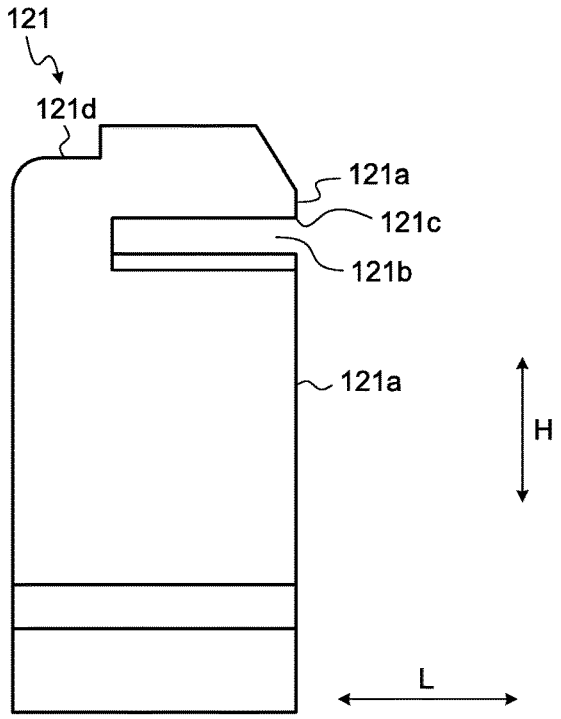
FIG. 11 is a side view illustrating a terminal cutting member according to the first embodiment.

The terminal cutting member 121 is formed into a parallelepiped, and is disposed so as to be slidable in the up-down direction along the front surface of the second anvil 112B. As illustrated in FIGS. 11 and 12, a slit 121*b* is formed in the terminal cutting member 121 from a sliding contact surface 121*a* with the second anvil 112B toward the inside. The slit 121*b* is a pathway of the joint piece 31 of the terminal chain member 30. When the crimp terminal 1 as the crimping target is supplied to the crimping position, part of the link portion 32 connecting to the crimp terminal 1 protrudes from the slit 121*b*. The crimp terminal 1 supplied to the crimping position is supported by the first mold 112 from the lower side.

The terminal cutting member 121 cuts the link portion 32 while relatively moving up and down with respect to the first mold 112 and the crimp terminal 1. Here, a position at which the joint piece 31 and the like can be inserted into the slit 121*b* is assumed to be a default position in the up-down direction of the terminal cutting member 121. As illustrated in FIG. 13, an end portion on the wire connection portion 12 side of the link portion 32 protrudes from the slit 121*b* via an opening on the sliding contact surface 121*a* side (i.e., the crimp terminal 1 side) of the slit 121*b*. In the terminal cutting member 121, an edge portion (hereinafter, referred to as an "opening edge".) 121*c* on the upper side in the opening is used as one terminal cutting portion. The other terminal cutting portion is a top surface edge 112*a* of the second anvil 112B.

The pressing member 122 is fixed to the ram 114A, and moves up and down integrally with the ram 114A. The pressing member 122 is disposed on the upper side of the terminal cutting member 121, and presses down the terminal cutting member 121 by lowering. The pressing member 122 is formed into a parallelepiped. The elastic member 123 is a member that adds upper urging force to the terminal cutting member 121, and is formed of a spring member or the like. The elastic member 123 returns the terminal cutting member 121 to the default position in the up-down direction when pressing force applied from the pressing member 122 is released.

In the terminal cutting mechanism 120, the pressing member 122 lowers together with the lowering of the second mold 113 in the crimping processing, to press down the terminal cutting member 121. By the terminal cutting member 121 lowering, the link portion 32 is sandwiched between the opening edge 121*c* of the slit 121*b* and the top surface edge 112*a* (FIG. 13) of the second anvil 112B. In the terminal cutting mechanism 120, the opening edge 121*c* and the top surface edge 112*a* function as scissors, and add shearing force to the link portion 32. By the terminal cutting member 121 being further pressed down, the opening edge 121*c* and the top surface edge 112*a* cut the link portion 32, and cut off the crimp terminal 1 from the joint piece 31. Note that, for enhancing cutting performance, the opening edge 121*c* is inclined on the sliding contact surface 121*a* with respect to the top surface edge 112*a*.

As illustrated in FIG. 13, the wire 50 as the crimping target is disposed at a predetermined position located between the terminal cutting member 121 and the pressing member 122. More specifically, the wire 50 is placed on a top surface 121*d* of the terminal cutting member 121. Thus, a space for letting the wire 50 escape is provided in at least one of an upper portion of the terminal cutting member 121 and a lower portion of the pressing member 122 so that the wire 50 is not squished therebetween.

Here, the predetermined position is a position at which the end portion of the wire 50 not having been subjected to the crimping processing exists on the upper side of the bottom portion 14 of the flat-plate-shaped wire connection portion 12. In addition, the predetermined position is a position at which the core wire 51 can be placed on the bottom portion 14 of the core wire crimping portion 12A so that the distal end of the core wire 51 that has been pressed down at the start of the crimping processing does not protrude from the core wire crimping portion 12A. The core wire 51 elongates in an axis line direction in accordance with the crimping processing, and a distal end position of the core wire 51 sometimes moves in the axis line direction. The predetermined position is desirably determined in consideration of the elongation.

The end portion (the core wire 51 at the distal end and the covering 52) of the wire 50 is pressed down by the second mold 113 toward the inner wall surface side of the wire connection portion 12. Thus, if no holding is provided, the wire 50 is uplifted from the top surface 121*d* of the terminal cutting member 121, and the core wire 51 at the distal end and the covering 52 may be crimped in a state of not being placed on the bottom portion 14 of the wire connection portion 12. Thus, the terminal crimping apparatus 100 of the present embodiment is provided with a wire holding mechanism that holds the wire 50 at the predetermined position between itself and the upper portion of the terminal cutting member 121, and suppresses a position shift of the end portion of the wire 50 with respect to the wire connection portion 12 that occurs in the crimping processing.

The wire holding mechanism includes a wire retaining member 118 (FIG. 13) that retains the wire 50 placed on the top surface 121*d* of the terminal cutting member 121 that serves as a wire placement portion, by pressing the wire 50 against the top surface 121*d*. The wire retaining member 118 is disposed on the upper side of the terminal cutting member 121, and between the second mold 113 and the pressing member 122. A space (hereinafter, referred to as a "wire holding space".) 118A for holding the covering 52 of the wire 50 is formed between the top surface 121*d* of the terminal cutting member 121 and the bottom surface of the wire retaining member 118. The wire holding space 118A suppresses the uplift of the wire 50 from the top surface 121*d* of the terminal cutting member 121 that occurs in the crimping process, and suppresses a position shift of the core wire 51 at the distal end and the covering 52 with respect to the wire connection portion 12. The wire retaining member 118 is a member that can move up and down with respect to the top surface 121*d* of the terminal cutting member 121, and forms the wire holding space 118A between itself and the upper portion of the terminal cutting member 121 by lowering. For example, the wire retaining member 118 is fixed to the ram 114A, and moves up and down integrally with the ram 114A. The wire 50 is held in the wire holding space 118A formed in accordance with the lowering of the wire retaining member 118.

Here, it is desired that a failure in crimping the wire connection portion 12 onto the wire 50 by winding the wire connection portion 12 around the wire 50 using the crimping machine 110 can be suppressed. Examples of expected failures include reversal (sign Pr2) of an overlap order of the barrel piece portions 15 and 16, interference (sign Pr1) between the barrel piece portions 15 and 16, and the like, as will be described with reference to FIG. 22. If such a failure occurs, a decrease in crimping strength and a decrease in water stop performance offered by the water stop member 20 may be caused. The crimp terminal 1 of the present embodiment has a configuration for suppressing a failure in crimping before happens, as described below.

Figure 3:
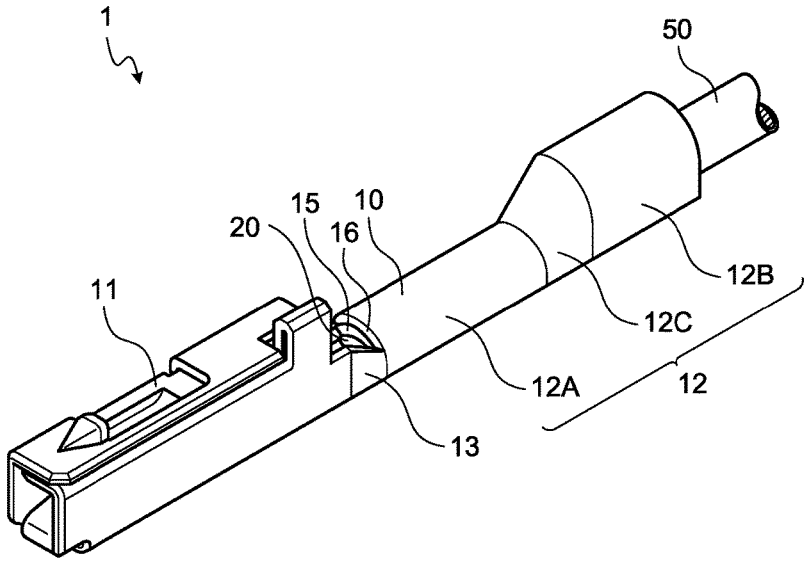
FIG. 3 is a perspective view illustrating the crimp terminal according to the first embodiment after crimping.
Figure 4:
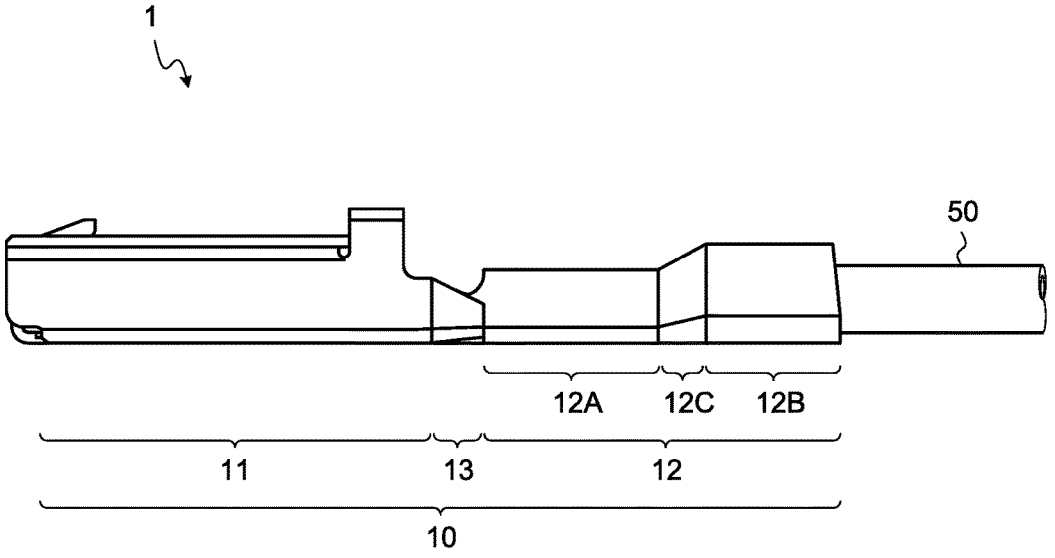
FIG. 4 is a side view illustrating the crimp terminal according to the first embodiment after crimping.

As illustrated in FIG. 3, the crimp terminal 1 of the present embodiment has a configuration in which the second barrel piece portion 16 overlaps the outside of the first barrel piece portion 15. More specifically, in the crimp terminal 1 of the present embodiment, as illustrated in FIG. 14, lengths of the barrel piece portions 15 and 16 are different. FIG. 14 illustrates a cross-sectional shape of the wire connection portion 12 in a cross section perpendicular to the longitudinal direction of the wire connection portion 12. As illustrated in FIG. 14, in the cross section perpendicular to the longitudinal direction of the wire connection portion 12, a length Ln2 of the second barrel piece portion 16 is longer than a length Ln1 of the first barrel piece portion 15. The respective lengths Ln1 and Ln2 of the barrel piece portions 15 and 16 are lengths of protrusion from the bottom portion 14. In accordance with the length Ln2 of the second barrel piece portion 16 being loner than the length Ln1 of the first barrel piece portion 15, a height position in the third direction H of an end surface 16*b* of the second barrel piece portion 16 is higher than a height position of an end surface 15*b* of the first barrel piece portion 15.

In addition, a distance R2 from a lowest point 14*a* of the bottom portion 14 to the end surface 16*b* of the second barrel piece portion 16 is longer than a distance R1 from the lowest point 14*a* to the end surface 15*b* of the first barrel piece portion 15. Because dimension of the first barrel piece portion 15 and the second barrel piece portion 16 are in such relationship, when the barrel piece portions 15 and 16 are bent inward by the second mold 113, the second barrel piece portion 16 overlaps the outside of the first barrel piece portion 15. In addition, the first barrel piece portion 15 includes a bent portion 15*d* bent so as to protrude outward. In the first barrel piece portion 15, a portion on the distal end side from the bent portion 15*d* is slightly inclined toward the second barrel piece portion 16 side. Thus, the first barrel piece portion 15 is formed to easily collapse into inner side of the second barrel piece portion 16.

In addition, in the present embodiment, winding with respect to the wire 50 is started from a center portion of the wire connection portion 12 so that airtightness and watertightness can be assured after the crimping. Because the wire connection portion 12 of the present embodiment integrally covers the core wire 51 and the covering 52 of the wire 50, the center portion of the wire connection portion 12 corresponds to an end portion of the covering 52, that is, a boundary between an exposed portion of the core wire 51 and the covering 52. In other words, in the present embodiment, winding of the wire connection portion 12 with respect to the wire 50 is started from a position corresponding to the end portion of the covering 52.

Figure 15:
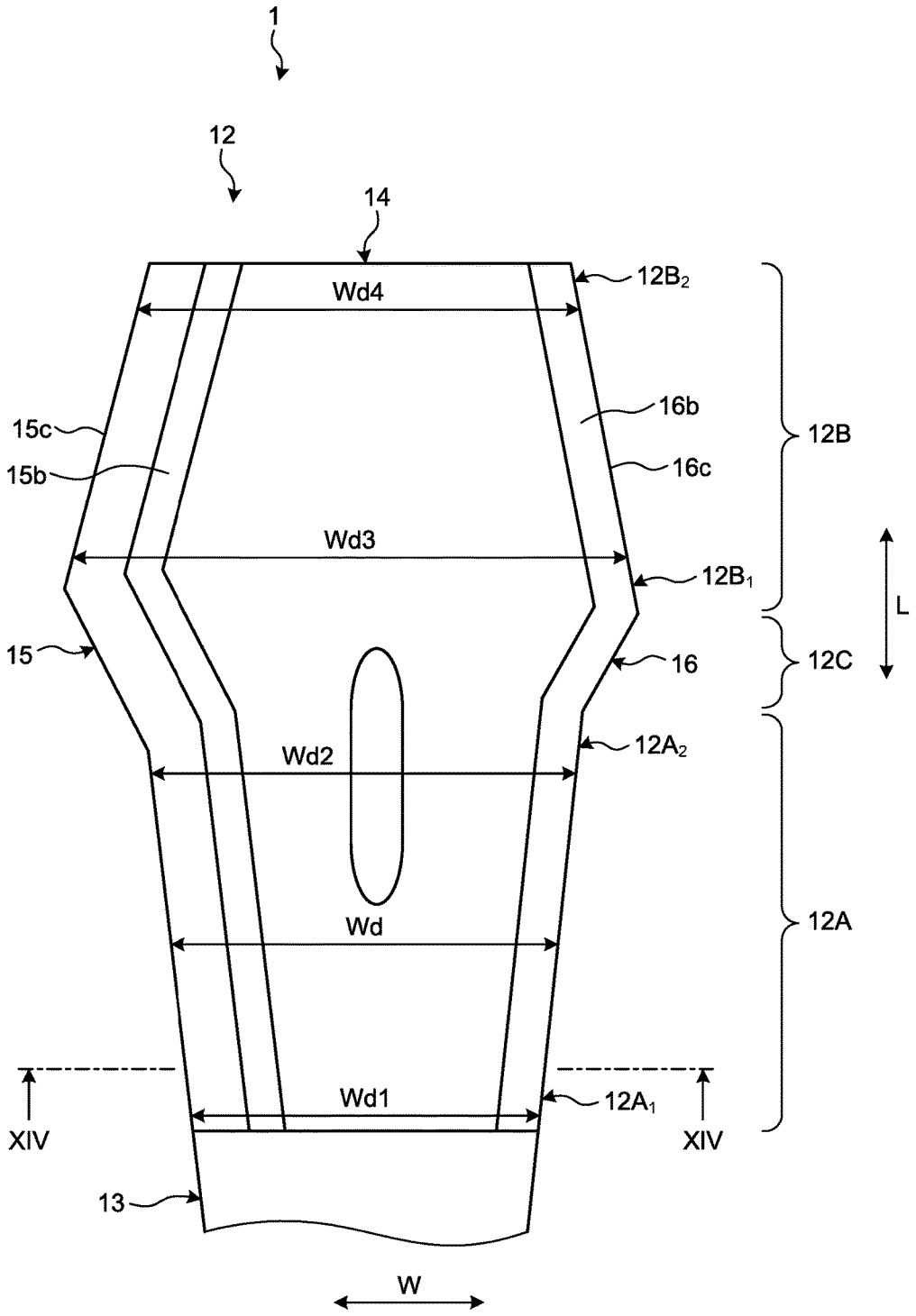
FIG. 15 is a plan view of the wire connection portion according to the first embodiment.

As will be described with reference to FIG. 15, in the wire connection portion 12 of the present embodiment, an interval Wd between outer wall surfaces varies according to a position in the longitudinal direction of the wire connection portion 12 so that winding is started in the above-described manner. FIG. 15 illustrates the wire connection portion 12 formed into a U-shape by the bending process, and the wire connection portion 12 before crimping onto the wire 50. As illustrated in FIG. 15, the interval Wd between outer wall surfaces of the barrel piece portions 15 and 16 varies according to a position in the longitudinal direction of the wire connection portion 12. Here, the interval Wd between outer wall surfaces is a distance in the second direction W from an outer wall surface 15*c* of the first barrel piece portion 15 to an outer wall surface 16*c* of the second barrel piece portion 16. In the present embodiment, the interval Wd between outer wall surfaces at a certain position in the longitudinal direction of the wire connection portion 12 indicates a distance between respective regions of the outer wall surfaces 15*c* and 16*c* that protrude the most in the second direction W. In other words, the interval Wd between outer wall surfaces can be said as an external dimension in the second direction W that is obtainable when the wire connection portion 12 is viewed from the above.

In the core wire crimping portion 12A before crimping onto the wire 50, the interval Wd between outer wall surfaces is widest at an end portion $12A_2$ (hereinafter, referred to as "a second end portion $12A_2$".) on the covering crimping portion 12B side. On the other hand, in the core wire crimping portion 12A, the interval Wd between outer wall surfaces is narrowest at an end portion $12A_1$ (hereinafter, referred to as "a first end portion $12A_1$".) on a side opposite to the covering crimping portion 12B. In addition, the interval Wd between outer wall surfaces becomes narrower from the second end portion $12A_2$ toward the first end portion $12A_1$. Note that, FIG. 15 exaggeratingly illustrates a difference between a value Wd1 of the interval Wd between outer wall surfaces at the first end portion $12A_1$ and a value Wd2 of the interval Wd between outer wall surfaces at the second end portion $12A_2$.

In the covering crimping portion 12B before crimping onto the wire 50, the interval Wd between outer wall surfaces is widest at an end portion $12B_1$ (hereinafter, referred to as "a third end portion $12B_1$".) on the core wire crimping portion 12A side. On the other hand, in the covering crimping portion 12B, the interval Wd between outer wall surfaces is narrowest at an end portion $12B_2$ (hereinafter, referred to as "a fourth end portion $12B_2$".) on a side opposite to the core wire crimping portion 12A. In addition, the interval Wd between outer wall surfaces becomes narrower from the third end portion $12B_1$ toward the fourth end portion $12B_2$. Note that, FIG. 15 exaggeratingly illustrates a difference between a value Wd3 of the interval Wd between outer wall surfaces at the third end portion $12B_1$, and a value Wd4 of the interval Wd between outer wall surfaces at the fourth end portion $12B_2$.

In a state before crimping, a cross-sectional area of an internal space of the covering crimping portion 12B is made wider than a cross-sectional area of an internal space of the core wire crimping portion 12A. This difference in area corresponds to a difference between an outer diameter of the covering 52 and an outer diameter of the core wire 51 as crimping target. According to the difference in sizes of the internal spaces, the value Wd3 of the interval Wd between outer wall surfaces at the third end portion $12B_2$ becomes larger than the value Wd2 of the interval Wd between outer wall surfaces at the second end portion $12A_2$. In other words, in the joint crimping portion 12C, the interval Wd between outer wall surfaces becomes wider from the core wire crimping portion 12A toward the covering crimping portion 12B.

When the wire connection portion 12 having such a configuration is crimped by the second mold 113, the second mold 113 initially comes into contact with the outer wall surfaces 15*c* and 16*c* at the position of the third end portion $12B_1$. In other words, the position at which the second mold 113 initially comes into contact with the outer wall surfaces 15*c* and 16*c* of the barrel piece portions 15 and 16 is a position of the third end portion $12B_1$ in the longitudinal direction of the wire connection portion 12. The third end portion $12B_1$ corresponds to a position corresponding to the end portion of the covering 52, that is, a position at which the core wire 51 starts to be exposed in the wire 50.

Figure 16:
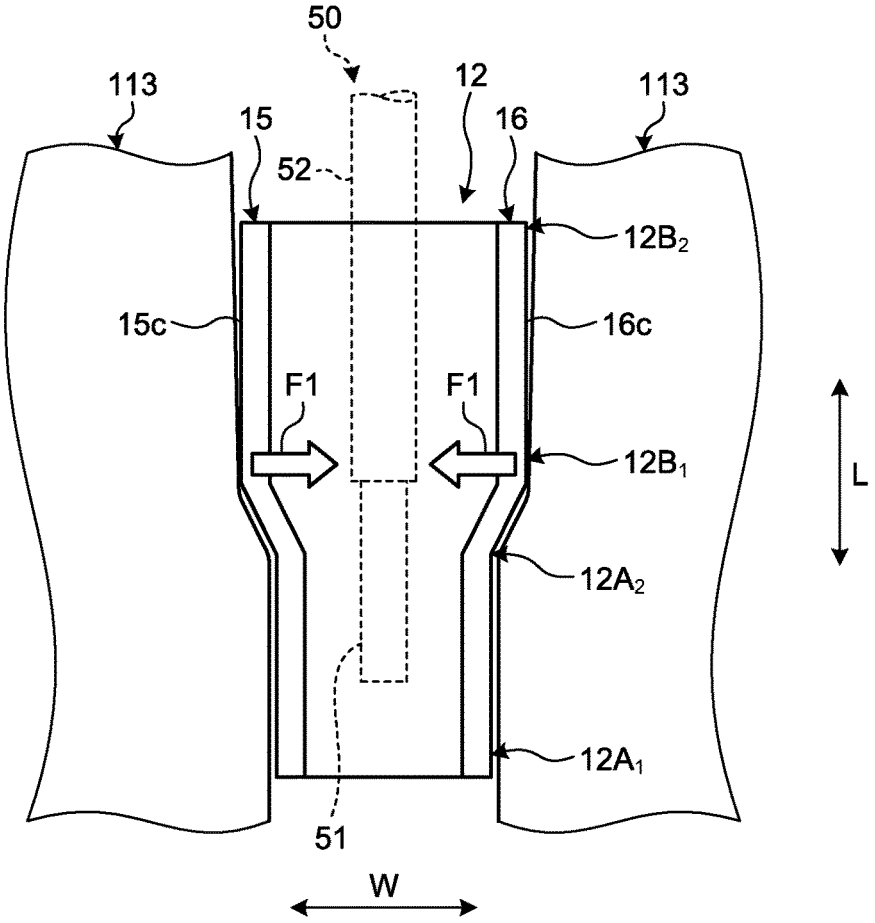
FIG. 16 is a plan view illustrating a contact start position of the second mold with respect to the wire connection portion.
Figure 17:
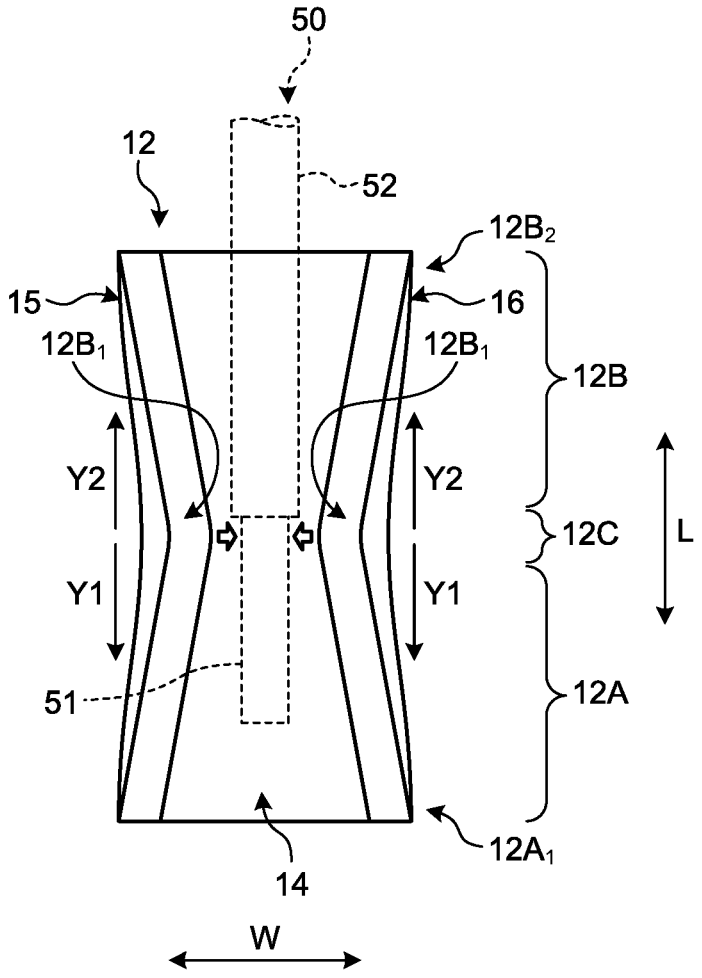
FIG. 17 is a plan view illustrating a deformation start of barrel piece portions.

As illustrated in FIG. 16, when starting the crimping of the wire connection portion 12, the second mold 113 initially comes into contact with the outer wall surfaces 15*c* and 16*c* of the barrel piece portions 15 and 16 at the position of the third end portion $12B_1$. While moving downward, the second mold 113 applies pressing force F1 to the outer wall surfaces 15*c* and 16*c*. As illustrated in FIG. 17, according to the pressing force F1, the barrel piece portions 15 and 16 each deform so as to collapse inward. In accordance with the progress of the deformation of the barrel piece portions 15 and 16, a contact area of the second mold 113 with respect to the outer wall surfaces 15*c* and 16*c* extends in the first direction L. More specifically, from the third end portion $12B_1$, the contact area of the second mold 113 with respect to the outer wall surfaces 15*c* and 16*c* extends toward the first end portion $12A_1$ as indicated by an arrow Y1, and extends toward the fourth end portion $12B_2$ as indicated by an arrow Y2. In other words, while bending the barrel piece portions 15 and 16 inward, the second mold 113 sequentially comes into contact with the outer wall surfaces 15*c* and 16*c* of the barrel piece portions 15 and 16 along the longitudinal direction of the wire connection portion 12.

Figure 18:
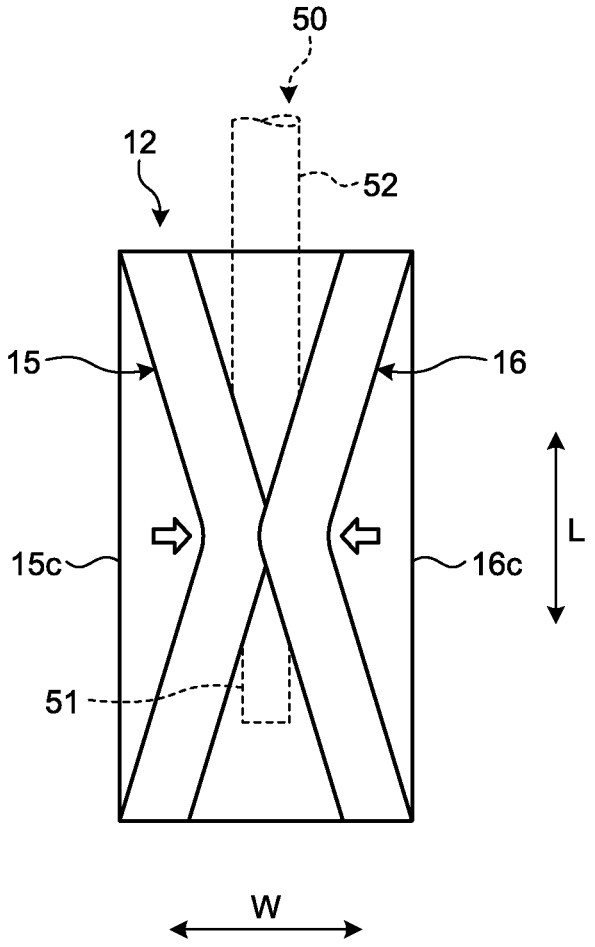
FIG. 18 is a plan view illustrating an overlap start of the barrel piece portions.
Figure 19:
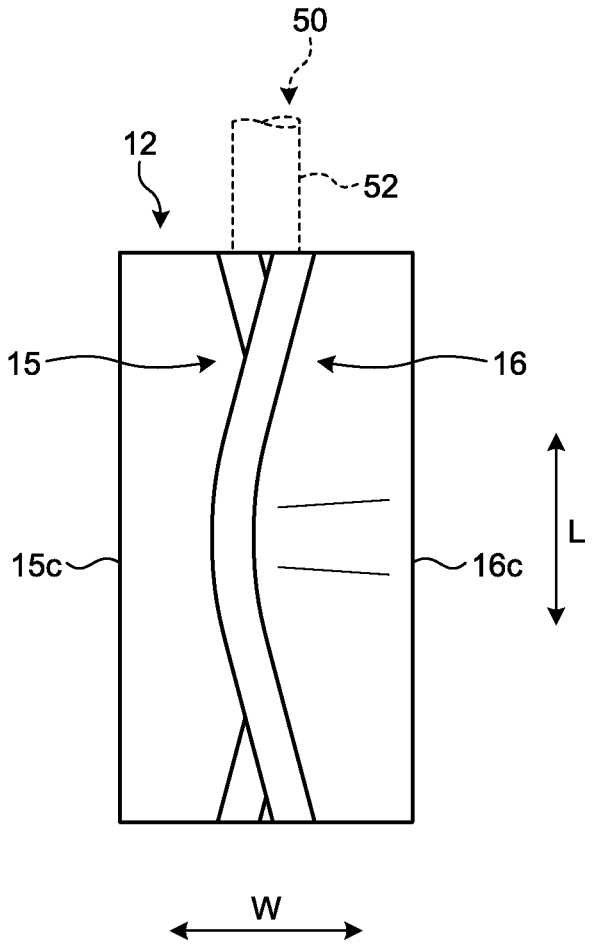
FIG. 19 is a plan view illustrating progress of overlap of the barrel piece portions.
Figure 20:
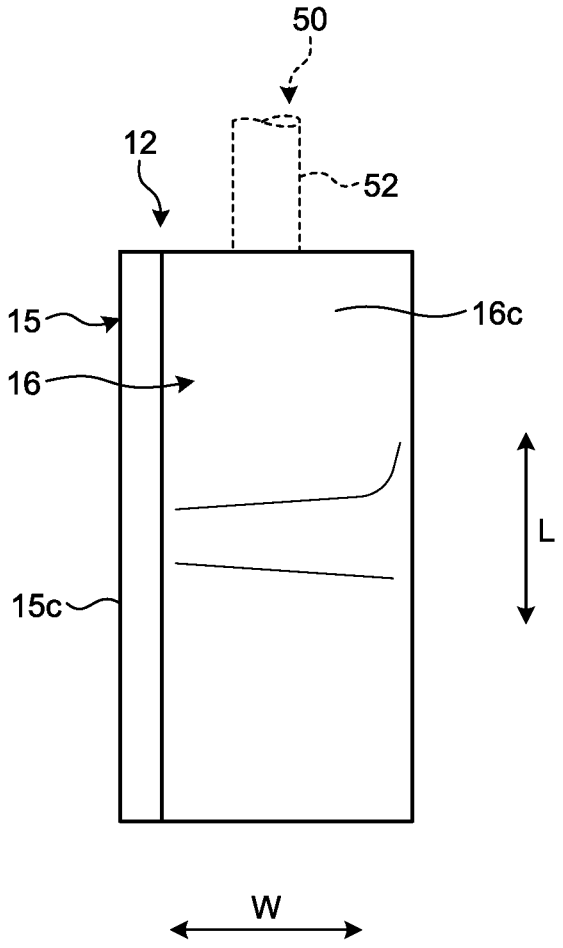
FIG. 20 is a plan view illustrating crimping completion of the wire connection portion.

As illustrated in FIG. 18, the barrel piece portions 15 and 16 bent inward by the second mold 113 start to overlap from a certain time point. By the second barrel piece portion 16 overlapping from the outside of the first barrel piece portion 15, the barrel piece portions 15 and 16 overlap each other when viewed from the above. When the second mold 113 moves further downward, as illustrated in FIG. 19, a range in which the barrel piece portions 15 and 16 overlap extends in the first direction L toward the both sides. When the second mold 113 moves further downward, the barrel piece portions 15 and 16 are pressed against the wire 50 by the second mold 113 in a state of wholly overlapping, and the crimping is completed as illustrated in FIG. 20.

As described above, in the crimp terminal 1 of the present embodiment, in the core wire crimping portion 12A before crimping onto the wire 50, the interval Wd between outer wall surfaces is widest at the second end portion $12A_2$ being an end portion on the covering crimping portion 12B side. In addition, in the covering crimping portion 12B before crimping onto the wire 50, the interval Wd between outer wall surfaces is widest at the third end portion $12B_1$ being an end portion on the core wire crimping portion 12A side. In this manner, the interval Wd between outer wall surfaces becomes the widest at a position closer to the center in the longitudinal direction in the wire connection portion 12. Thus, the winding of the wire connection portion 12 with respect to the wire 50 is started from the center portion, and the start of the winding is delayed at the both ends in the longitudinal direction. This suppresses interference between the barrel piece portions 15 and 16, and the reversal of a winding order, as described below.

Figure 21:
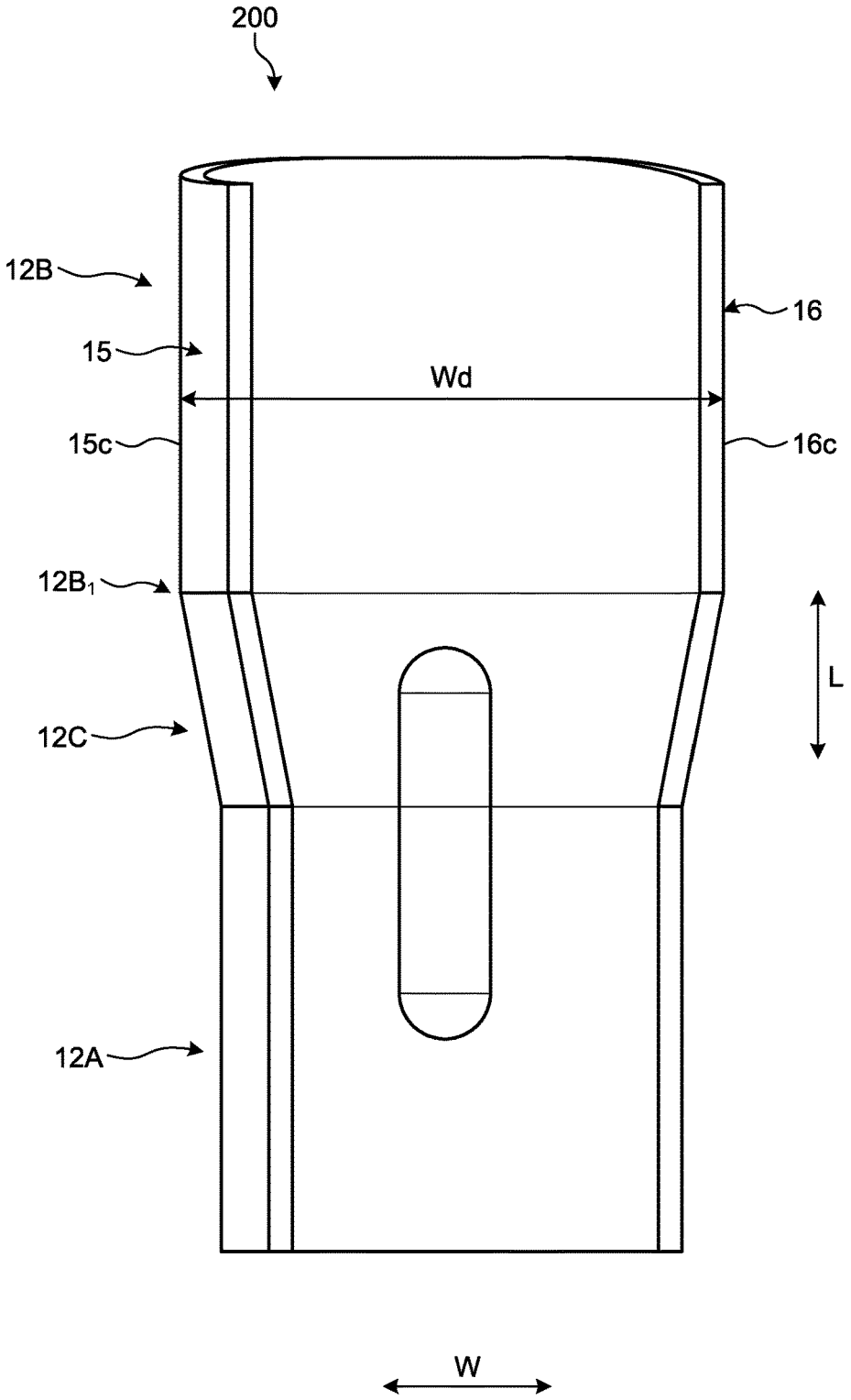
FIG. 21 is a plan view illustrating a wire connection portion of a comparative example.

FIG. 21 illustrates a wire connection portion 200 of a comparative example. In the wire connection portion 200 of the comparative example, in the core wire crimping portion 12A and the covering crimping portion 12B, a position at which the interval Wd between outer wall surfaces becomes widest is not defined, unlike the wire connection portion 12 of the present embodiment. As an example, it is assumed that, in portions in the covering crimping portion 12B that are other than the third end portion $12B_1$, the interval Wd between outer wall surfaces is allowed to become widest. In this case, a position at which winding with respect to the wire 50 is started in the wire connection portion 200, that is, a position that the second mold 113 initially comes into contact with is considered to be determined by manufacturing variations of components, and the like. The way of progress of the deformation of the barrel piece portions 15 and 16 varies according to a position at which the winding is started. As a result, a failure may occur in the crimping process.

Figure 22:
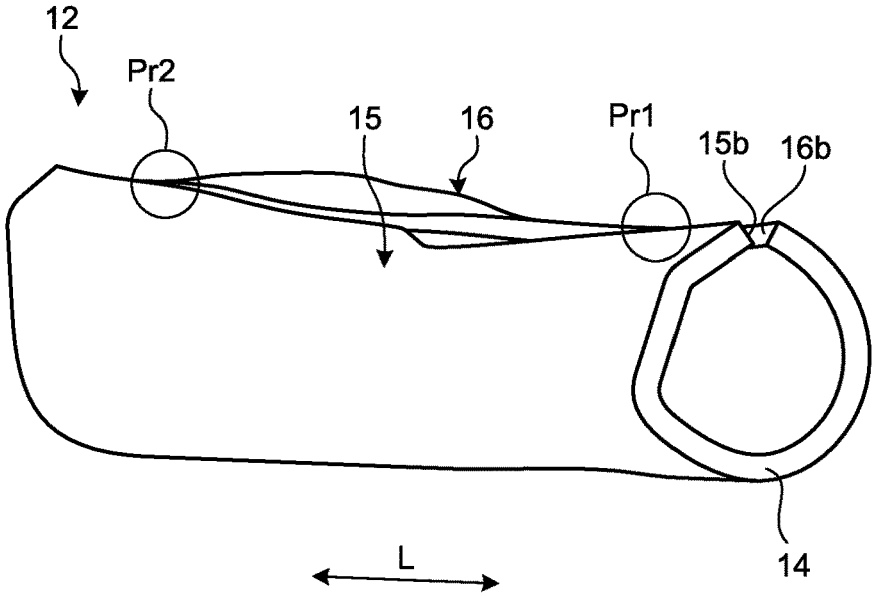
FIG. 22 is a perspective view illustrating a failure in crimping.

For example, as indicated by the sign Pr1 in FIG. 22, the end surface 15*b* of the first barrel piece portion 15 and the end surface 16*b* of the second barrel piece portion 16 may collide with each other. In addition, as indicated by the sign Pr2, the first barrel piece portion 15 may overlap the outside of the second barrel piece portion 16. As an example in which such a failure occurs, it is considered that winding is started at a plurality of locations in the longitudinal direction of the wire connection portion 12, and a winding start of an intermediate portion is delayed. In this case, strain generated by the deformation started from the both ends may generate interference between the barrel piece portions 15 and 16, and the reversal of the winding order in the intermediate portion.

Figure 23:
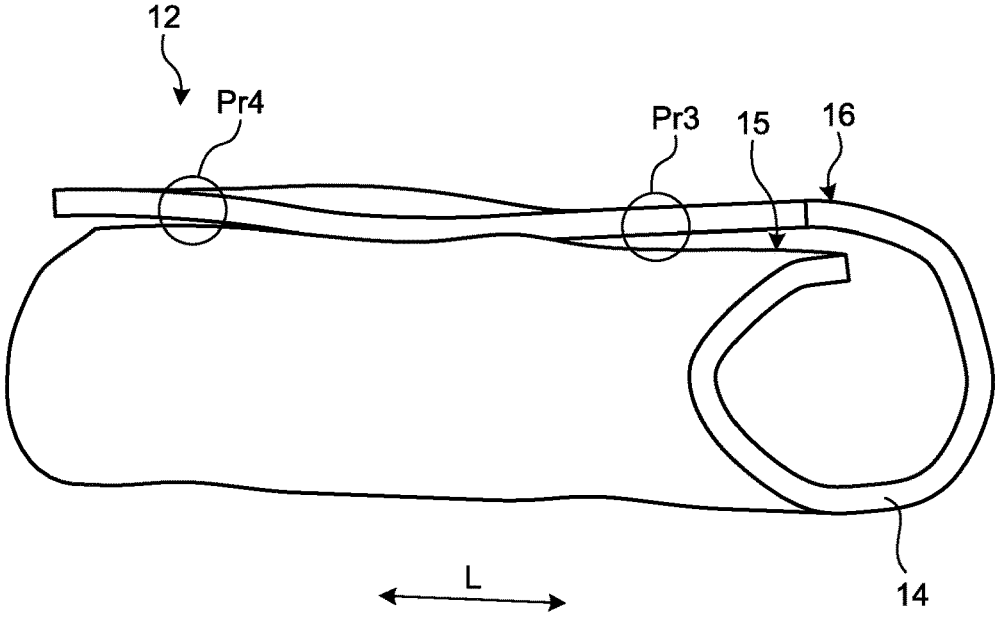
FIG. 23 is a perspective view illustrating a state of deformation of the wire connection portion according to the first embodiment.

On the other hand, in the crimp terminal 1 of the present embodiment, the interval Wd between outer wall surfaces in the core wire crimping portion 12A is the widest at the position of the second end portion $12A_2$, and the interval Wd between outer wall surfaces in the covering crimping portion 12B is the widest at the third end portion $12B_1$. Thus, in the core wire crimping portion 12A and the covering crimping portion 12B, winding is started from the end portions $12A_2$ and $12B_1$ closer to the center in the longitudinal direction of the wire connection portion 12. As illustrated in FIG. 23, overlap of the barrel piece portions 15 and 16 is started at the center portion of the wire connection portion 12, and the overlap is propagated toward the both sides in the longitudinal direction of the wire connection portion 12.

Thus, according to the crimp terminal 1 of the present embodiment, a start of winding at a position different from a desired position and a delay of a winding start at the center portion are suppressed. The winding and crimping of the wire connection portion 12 with respect to the wire 50 can be thereby performed stably. Thus, the generation of interference between the barrel piece portions 15 and 16 and the reversal of the winding order is suppressed. By the winding being sequentially performed from a predetermined position toward the both ends, as illustrated in FIG. 23, the first barrel piece portion 15 smoothly collapses into inner side of the second barrel piece portion 16. In addition, during the crimping, a clearance between the first barrel piece portion 15 and the second barrel piece portion 16 is appropriately ensured (signs Pr3 and Pr4). By the clearance being appropriately ensured, disturbance of the winding of the first barrel piece portion 15 with respect to the wire 50 is suppressed. In other words, in a state in which the first barrel piece portion 15 is tightly wound around the wire 50, the second barrel piece portion 16 is wound around the outside of the first barrel piece portion 15. Thus, crimping with respect to the wire 50 is performed with appropriate strength, and water stop performance is appropriately offered by the water stop member 20.

As described above, the crimp terminal 1 of the present embodiment includes the wire connection portion 12. The wire connection portion 12 includes the core wire crimping portion 12A provided at one end side in the longitudinal direction, and the covering crimping portion 12B provided at the other end side in the longitudinal direction, and integrally covers the core wire 51 and the covering 52 by being crimped onto the wire 50. In the core wire crimping portion 12A before crimping onto the wire 50, the interval Wd between the outer wall surfaces 15*c* and 16*c* of the barrel piece portions 15 and 16 is widest at the second end portion $12A_2$ on the covering crimping portion 12B side. In addition, in the covering crimping portion 12B before crimping onto the wire 50, the interval Wd between the outer wall surfaces 15*c* and 16*c* of the barrel piece portions 15 and 16 is widest at the third end portion $12B_1$ on the core wire crimping portion 12A side.

Thus, in the crimp terminal 1 of the present embodiment, winding with respect to the wire 50 is started in a region closer to the center in the longitudinal direction of the wire connection portion 12. In addition, winding and crimping with respect to the wire 50 progress from the region closer to the center in the longitudinal direction of the wire connection portion 12, toward the both ends. Thus, the crimp terminal 1 of the present embodiment can be appropriately crimped onto the wire 50.

In addition, in the crimp terminal 1 of the present embodiment, winding is started from the center portion of the wire connection portion 12. This can cause the wire connection portion 12 and the core wire 51 to equally extend toward the both sides in the longitudinal direction of the wire connection portion 12. Because winding and crimping with respect to the wire 50 progress from the center portion of the wire connection portion 12 toward the both ends, elongation of the wire connection portion 12 and the core wire 51 is difficult to be disturbed by the second mold 113. Thus, the wire connection portion 12 is appropriately crimped onto the wire 50.

In addition, in the crimp terminal 1 of the present embodiment, in the core wire crimping portion 12A before crimping onto the wire 50, the interval Wd between outer wall surfaces becomes narrower toward the first end portion $12A_1$ on a side opposite to the covering crimping portion 12B. In addition, in the covering crimping portion 12B before crimping onto the wire 50, the interval Wd between outer wall surfaces becomes narrower toward the fourth end portion $12B_2$ on a side opposite to the core wire crimping portion 12A. Thus, winding and crimping with respect to the wire 50 progress more smoothly from the center side in the longitudinal direction of the wire connection portion 12 toward the both ends.

In addition, in the crimp terminal 1 of the present embodiment, in the cross section perpendicular to the longitudinal direction of the wire connection portion 12, the length Ln2 of the second barrel piece portion 16, which is one of the barrel piece portions 15 and 16, is longer than the length Ln1 of the first barrel piece portion 15. In other words, when comparison is performed at the same position in the first direction L, the length Ln2 from a root on the bottom portion 14 side of the second barrel piece portion 16 to the end surface 16*b* is longer than the length Ln1 from a root on the bottom portion 14 side of the first barrel piece portion 15 to the end surface 15*b*. Thus, the first barrel piece portion 15 easily collapses into inner side of the second barrel piece portion 16. Because the lengths Ln1 and Ln2 of the barrel piece portions 15 and 16 are different in this manner, the reversal of the winding order of the barrel piece portions 15 and 16 with respect to the wire 50 is difficult to be generated.

Note that, in the crimp terminal 1 of the present embodiment, although the core wire crimping portion 12A and the covering crimping portion 12B are linked via the joint crimping portion 12C, the joint crimping portion 12C may be omitted. A portion corresponding to the joint crimping portion 12C of the present embodiment may be provided as a part of the core wire crimping portion 12A, or may be provided as a part of the covering crimping portion 12B.

In the present embodiment, in the core wire crimping portion 12A, intervals Wd between outer wall surfaces have relationship represented by the following formula (1), and in the covering crimping portion 12B, intervals Wd between outer wall surfaces have relationship represented by the following formula (2).

$$Wd1<Wd2 \quad (1)$$

$$Wd4<Wd3 \quad (2)$$

Alternatively, in the core wire crimping portion 12A, the intervals Wd between outer wall surfaces may have relationship represented by the following formula (3), and in the covering crimping portion 12B, the intervals Wd between outer wall surfaces may have relationship represented by the following formula (4).

$$Wd1 \leq Wd2 \quad (3)$$

$$Wd4 \leq Wd3 \quad (4)$$

Note that, the material of the core wire 51 of the wire 50 is not limited to aluminum. For example, the core wire 51 may be copper or copper alloy, or another conductive metal. The material of the crimp terminal 1 is not limited to copper and copper alloy, and may be another conductive metal.

Second Embodiment

Figure 24:
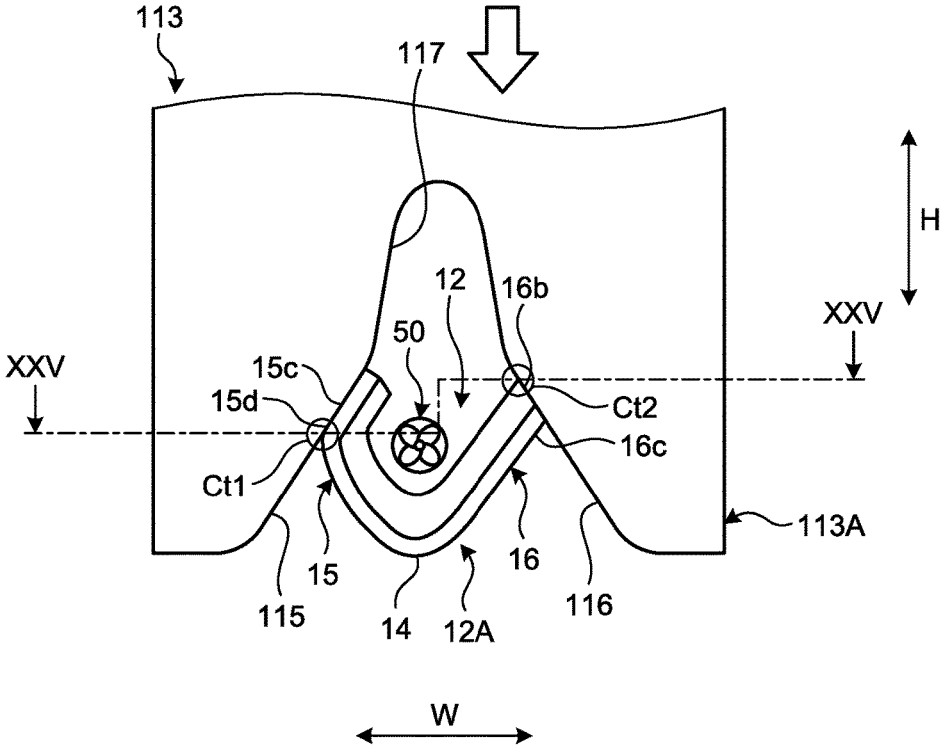
FIG. 24 is a front view of a second mold according to a second embodiment.
Figure 25:
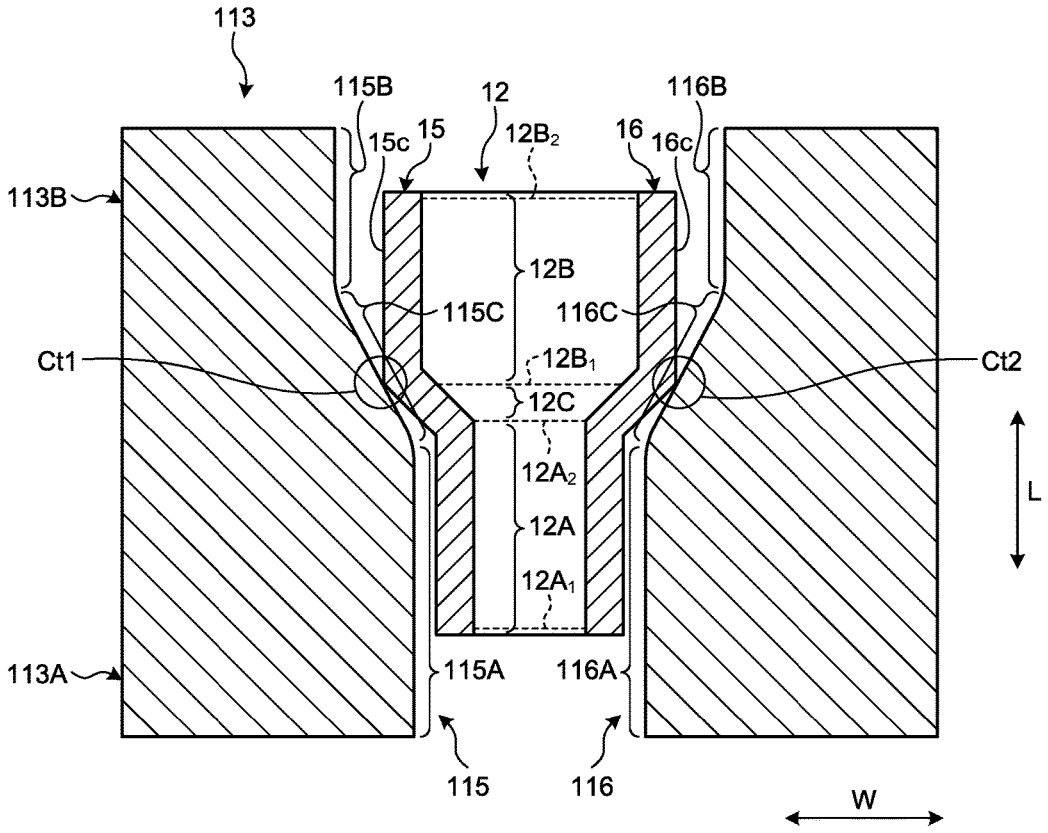
FIG. 25 is a cross-sectional view of the second mold according to the second embodiment.

A second embodiment will be described with reference to FIGS. 24 and 25. In the second embodiment, components having functions similar to those described in the above-described first embodiment are assigned the same signs, and the redundant description will be omitted. FIG. 24 is a front view of a second mold according to the second embodiment, and FIG. 25 is a cross-sectional view of the second mold according to the second embodiment. FIG. 25 illustrates a XXV-XXV cross section in FIG. 24. Note that, in FIG. 25, the wire 50 is omitted. The second embodiment differs from the above-described first embodiment in that the second mold 113 has such a configuration that a position at which the second mold 113 initially comes into contact with the outer wall surfaces 15*c* and 16*c* becomes a desired position.

Note that, the crimp terminal 1 to be crimped by the second mold 113 of the present embodiment may be the one having a defined interval Wd between outer wall surfaces, similar to the crimp terminal 1 of the above-described first embodiment, but may be another crimp terminal.

FIG. 25 illustrates a cross section passing through a contact location Ct1 between the first wall surface 115 of the second mold 113 and the first barrel piece portion 15, and a contact location Ct2 between the second wall surface 116 of the second mold 113 and the second barrel piece portion 16. As illustrated in FIG. 24, the second mold 113 lowering in the crimping process comes into contact with the outer wall surface 15*c* of the first barrel piece portion 15 and the outer wall surface 16*c* of the second barrel piece portion 16. The first wall surface 115 of the second mold 113 comes into contact with the outer wall surface 15*c* of the first barrel piece portion 15 to press the first barrel piece portion 15 toward the second wall surface 116 side. For example, the first wall surface 115 starts contact with the outer wall surface 15*c* in the bent portion 15*d* of the first barrel piece portion 15 or in the vicinity of the bent portion 15*d*.

On the other hand, the second wall surface 116 of the second mold 113 comes into contact with the outer wall surface 16*c* of the second barrel piece portion 16 to press the second barrel piece portion 16 toward the first wall surface 115 side. For example, the second wall surface 116 starts contact with the outer wall surface 16*c* at a corner portion at which the outer wall surface 16*c* and the end surface 16*b* of the second barrel piece portion 16 intersects with each other, or in the vicinity of the corner portion.

As illustrated in FIG. 25, the first wall surface 115 of the second mold 113 includes a core wire side wall surface 115A, a covering side wall surface 115B, and a joint wall surface 115C. The second wall surface 116 of the second mold 113 includes a core wire side wall surface 116A, a covering side wall surface 116B, and a joint wall surface 116C. The core wire side wall surfaces 115A and 116A are wall surfaces corresponding to the core wire crimping portion 12A. The core wire side wall surfaces 115A and 116A come into contact with the core wire crimping portion 12A to crimp the core wire crimping portion 12A onto the core wire 51. An interval between the core wire side wall surfaces 115A and 116A remains constant along the first direction L.

The covering side wall surfaces 115B and 116B are wall surfaces corresponding to the covering crimping portion 12B. The covering side wall surfaces 115B and 116B come into contact with the covering crimping portion 12B to crimp the covering crimping portion 12B onto the covering 52. An interval between the covering side wall surfaces 115B and 116B remains constant along the first direction L.

The joint wall surface 115C is a wall surface connection the core wire side wall surface 115A and the covering side wall surface 115B. The joint wall surface 115C is inclined with respect to the first direction L. The joint wall surface 115C is inclined in a direction to go away from the second wall surface 116, from the core wire side wall surface 115A toward the covering side wall surface 115B. The joint wall surface 116C is a wall surface connecting the core wire side wall surface 116A and the covering side wall surface 116B. The joint wall surface 116C is inclined with respect to the first direction L. The joint wall surface 116C is inclined in a direction to go away from the first wall surface 115, from the core wire side wall surface 116A toward the covering side wall surface 116B. The joint wall surfaces 115C and 116C face each other while sandwiching at least the third end portion 12$B_1$ of the covering crimping portion 12B therebetween. In addition, the joint wall surfaces 115C and 116C face each other while sandwiching the joint crimping portion 12C therebetween.

The second mold 113 is formed so as to start contact with the outer wall surfaces 15*c* and 16*c* at the center portion in the longitudinal direction of the wire connection portion 12. The second mold 113 of the present embodiment is configured to initially come into contact with the outer wall surfaces 15*c* and 16*c* at the position of the third end portion 12$B_1$ in the center portion in the longitudinal direction of the wire connection portion 12. The position of the third end portion 12$B_1$ is a position corresponding to the end portion of the covering 52 in the longitudinal direction of the wire connection portion 12.

The inclination of the joint wall surfaces 115C and 116C is defined so that the joint wall surfaces 115C and 116C initially come into contact with the outer wall surfaces 15*c* and 16*c* at the position of the third end portion 12$B_1$. An inclination angle of the joint wall surfaces 115C and 116C with respect to the first direction L is smaller than an inclination angle of the joint crimping portion 12C with respect to the first direction L. In other words, a degree of change in the interval between the joint wall surfaces 115C and 116C in the first direction L is smaller than a degree of change in the interval Wd between outer wall surfaces in the joint crimping portion 12C in the first direction L. Thus, clearance gaps between the joint crimping portion 12C and the joint wall surfaces 115C and 116C become narrower from the core wire crimping portion 12A toward the covering crimping portion 12B.

When the second mold 113 having such a configuration lowers toward the first mold 112 in the crimping process, the second mold 113 initially comes into contact with the outer wall surfaces 15*c* and 16*c* at the position of the third end portion 12$B_1$. When the second mold 113 further lowers, a range in which the second mold 113 and the outer wall surfaces 15*c* and 16*c* are in contact extends in the first direction L from the third end portion 12$B_1$ toward the both sides. While extending a contact area with the outer wall surfaces 15*c* and 16*c*, the second mold 113 bends the barrel piece portions 15 and 16 inward to wind the barrel piece portions 15 and 16 around the wire 50. When the second mold 113 further lowers, the second mold 113 presses the barrel piece portions 15 and 16 wound around the wire 50, against the wire 50. The wire connection portion 12 is thereby crimped onto the wire 50.

In this manner, the terminal crimping apparatus 100 of the present embodiment causes a winding start of the center portion of the wire connection portion 12 to precede a winding start of the both end portions. In addition, the terminal crimping apparatus 100 makes the progress of the winding of the center portion faster than the progress of the winding of the both end portions. Then, the terminal crimping apparatus 100 causes the crimping of the center portion to be completed prior to the completion of the crimping of the both end portions. The winding of the wire connection portion 12 with respect to the wire 50 sequentially progresses from the center portion toward the both end portions. This suppresses the uplift of the barrel piece portions 15 and 16, the generation of a clearance gap resulting from deformation, and the like. Thus, the terminal crimping apparatus 100 of the present embodiment can appropriately crimp the wire connection portion 12 onto the wire 50, assure required crimping strength, and suppress a decrease in water stop performance offered by the water stop member 20.

According to the terminal crimping apparatus 100 of the present embodiment, winding of the wire connection portion 12 with respect to the wire 50 is initially started at the third end portion 12$B_1$ being a position corresponding to the end portion of the covering 52. In the crimp terminal 1 integrally covering the core wire 51 and the covering 52, the outer diameter of the covering crimping portion 12B easily becomes larger than the outer diameter of the core wire crimping portion 12A. Thus, by the winding being started from the third end portion 12$B_1$, the winding easily progresses smoothly toward the both sides in the longitudinal direction of the wire connection portion 12. Thus, the terminal crimping apparatus 100 of the present embodiment can appropriately crimp the wire connection portion 12 onto the wire 50, assure required crimping strength, and suppress a decrease in water stop performance offered by the water stop member 20.

In addition, according to the terminal crimping apparatus 100 of the present embodiment, because the winding is started from the center portion of the wire connection portion 12, the wire connection portion 12 and the core wire 51 can be caused to equally elongate toward the both sides in the longitudinal direction of the wire connection portion 12. Because the winding and crimping progress from the center portion of the wire connection portion 12 toward the both ends, elongation of the wire connection portion 12 and the core wire 51 is difficult to be disturbed by the second mold 113. Thus, the wire connection portion 12 is appropriately crimped onto the wire 50.

The second mold 113 of the present embodiment is not limited to the one having a defined interval Wd between outer wall surfaces as in the crimp terminal 1 of the above-described first embodiment, and can be applied to a crimp terminal integrally covering the core wire 51 and the covering 52. The crimping target wire connection portion 12 includes the core wire crimping portion 12A and the covering crimping portion 12B, and integrally covers the core wire 51 and the covering 52 by being crimped onto the wire 50. In the wire connection portion 12 before crimping, the outer diameter of the covering crimping portion 12B is preferably larger than the outer diameter of the core wire crimping portion 12A. Nevertheless, the wire connection portion 12 is not limited to this.

Modified Example of Embodiments

A modified example of the above-described first and second embodiments will be described. In a cross section perpendicular to the longitudinal direction of the wire connection portion 12, lengths of the barrel piece portions 15 and 16 may be equal. In this case, the second mold 113 is formed so as to cause the first barrel piece portion 15 to collapse into inner side of the second barrel piece portion 16.

The matters disclosed in the above-described embodiments and the modified example can be executed while being appropriately combined.

A crimp terminal according to the embodiment includes a wire connection portion including a bottom wall portion, and a pair of side wall portions facing each other in a width direction of the bottom wall portion, and protruding from both ends in the width direction of the bottom wall portion. The wire connection portion includes a core wire crimping portion provided on one end side in a longitudinal direction, and to be crimped onto a core wire of a wire, and a covering crimping portion provided on another end side in the longitudinal direction, and to be crimped onto a covering of the wire, and integrally covers the core wire and the covering by being crimped onto the wire. In the core wire crimping portion before crimping onto the wire, an interval between outer wall surfaces of the pair of side wall portions is widest at an end portion on the covering crimping portion side, and in the covering crimping portion before crimping onto the wire, an interval between outer wall surfaces of the pair of side wall portions is widest at an end portion on the core wire crimping portion side.

In the crimp terminal according to the embodiment, winding with respect to the wire is started from a position closer to the center in the longitudinal direction of the wire connection portion. Thus, the crimp terminal according to the embodiment brings about such an effect that the crimp terminal can be appropriately crimped onto the wire.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

a wire connection portion including a bottom wall portion, and a pair of side wall portions facing each other in a width direction of the bottom wall portion, and protruding from both ends in the width direction of the bottom wall portion, wherein the wire connection portion includes a core wire crimping portion provided on one end side in a longitudinal direction, and to be crimped onto a core wire of a wire, and a covering crimping portion provided on another end side in the longitudinal direction, and to be crimped onto a covering of the wire, and integrally covers the core wire and the covering by being crimped onto the wire, one of the pair of side wall portions is a first barrel piece portion including a bent portion bent so as to protrude outward, and the other of the pair of side wall portions is a second barrel piece portion, in the core wire crimping portion before crimping onto the wire, an interval between outer wall surfaces of the pair of side wall portions is widest at an end portion on the covering crimping portion side, in the covering crimping portion before crimping onto the wire, an interval between outer wall surfaces of the pair of side wall portions is widest at an end portion on the core wire crimping portion side, and the interval between outer wall surfaces of the pair of side wall portions is a distance between an outer wall surface of the bent portion and an outer wall surface of the second barrel piece portion.

2. The crimp terminal according to claim 1, wherein, in the core wire crimping portion before crimping onto the wire, an interval between outer wall surfaces of the pair of side wall portions becomes narrower toward an end portion on an opposite side of the covering crimping portion, and in the covering crimping portion before crimping onto the wire, an interval between outer wall surfaces of the pair of side wall portions becomes narrower toward an end portion on an opposite side of the core wire crimping portion.

3. The crimp terminal according to claim 1, wherein, in a cross section perpendicular to a longitudinal direction of the wire connection portion, a length of one side wall portion of the pair of side wall portions is longer than a length of another side wall portion.

4. The crimp terminal according to claim 2, wherein, in a cross section perpendicular to a longitudinal direction of the wire connection portion, a length of one side wall portion of the pair of side wall portions is longer than a length of another side wall portion.

5. A terminal crimping method comprising:

a crimping step of crimping a wire connection portion onto a core wire and a covering of a wire by a mold, the wire connection portion including a bottom wall portion, and a pair of side wall portions facing each other in a width direction of the bottom wall portion, and protruding from both ends in the width direction of the bottom wall portion, wherein one of the pair of side wall portions is a first barrel piece portion including a bent portion bent so as to protrude outward, and the other of the pair of side wall portions is a second barrel piece portion, the mold includes a first mold configured to support a bottom wall portion of the wire connection portion, and a second mold configured to come into contact with outer wall surfaces of the pair of side wall portions while relatively moving with respect to the first mold, and bend the pair of side wall portions inward to crimp the pair of side wall portions onto the wire, and in the crimping step, the second mold starts contact with the outer wall surfaces of the bent portion and the second barrel piece portion at a center portion in the longitudinal direction of the wire connection portion.

6. The terminal crimping method according to claim 5, wherein a position at which the second mold starts contact with the outer wall surfaces of the pair of side wall portions is a position corresponding to an end portion of the covering of the wire.

* * * * *